US009445680B2

(12) United States Patent
Bean et al.

(10) Patent No.: US 9,445,680 B2
(45) Date of Patent: Sep. 20, 2016

(54) DEVICE FOR FACILITATING SELF-DRESSING

(71) Applicant: Sheri Denise Bean, Oregon City, OR (US)

(72) Inventors: Sheri Denise Bean, Oregon City, OR (US); Richard May, Manhattan Beach, CA (US)

(73) Assignee: Sheri Bean, Oregon City, OR (US)

( * ) Notice: Subject to any disclaimer, the term of this patent is extended or adjusted under 35 U.S.C. 154(b) by 0 days.

(21) Appl. No.: 14/595,113

(22) Filed: Jan. 12, 2015

(65) Prior Publication Data

US 2016/0198880 A1 Jul. 14, 2016

Related U.S. Application Data

(60) Provisional application No. 61/926,802, filed on Jan. 13, 2014.

(51) Int. Cl.
*A47G 25/90* (2006.01)
*A47G 25/80* (2006.01)

(52) U.S. Cl.
CPC ..... *A47G 25/90* (2013.01); *A47G 25/80* (2013.01); *A47G 25/905* (2013.01)

(58) Field of Classification Search
CPC .. A47G 25/90; A47G 25/905; A47G 25/907; A47G 25/80; A47G 25/82
USPC ..... D2/641
See application file for complete search history.

(56) References Cited

U.S. PATENT DOCUMENTS

| | | | | | |
|---|---|---|---|---|---|
| 2,894,669 | A * | 7/1959 | Silken | A47G 25/905 | 223/111 |
| 2,982,453 | A * | 5/1961 | Zicarelli | A47G 25/905 | 223/112 |
| 3,231,160 | A * | 1/1966 | Glanville | A47G 25/905 | 223/111 |
| 3,993,228 | A * | 11/1976 | Fuhr | A47G 25/905 | 223/111 |
| 4,252,063 | A * | 2/1981 | Brooks, Jr. | A61H 3/008 | 104/307 |
| 7,070,074 | B2 * | 7/2006 | Landsberger | A47G 25/905 | 223/111 |
| 8,083,110 | B2 * | 12/2011 | Wilkens | A47G 25/905 | 223/111 |
| 8,528,796 | B1 * | 9/2013 | Bosko | A47G 25/905 | 223/111 |
| 2006/0076372 | A1 * | 4/2006 | Delamare | A47G 25/908 | 223/111 |
| 2013/0082016 | A1 * | 4/2013 | Arrow | A63B 71/00 | 211/85.1 |

FOREIGN PATENT DOCUMENTS

| | | | |
|---|---|---|---|
| CN | WO9602174 | * | 2/1996 |
| WO | WO2011085439 | * | 7/2011 |

* cited by examiner

*Primary Examiner* — Ismael Izaguirre
(74) *Attorney, Agent, or Firm* — Milord A. Keshishian

(57) ABSTRACT

A portable device that facilitates and aids in self-dressing lower as well as upper body with single and or multiple articles of clothing with minimal physical motion, and coordination (e.g., exertion, bending, squeezing, gripping, twisting etc.). The portable device includes a base that supports and provides stability for maintaining the portable device in an upright position, and defines a workspace for positioning articles of clothing. Further included is a first retainer associated with the base, a second retainer associated with a handle, and a first and second side posts adjustably and moveably associated with the base.

23 Claims, 21 Drawing Sheets

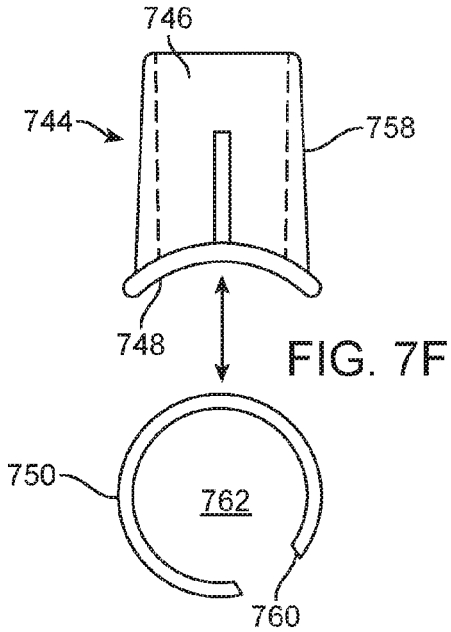
FIG. 7F
FIG. 7H
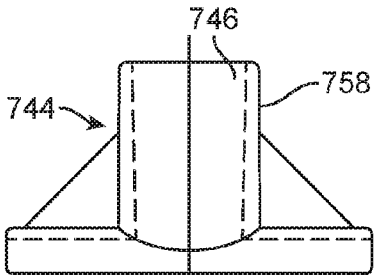
FIG. 7G
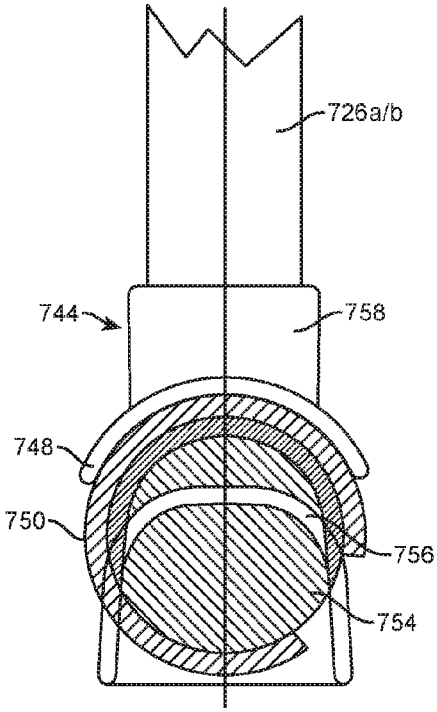
FIG. 7I
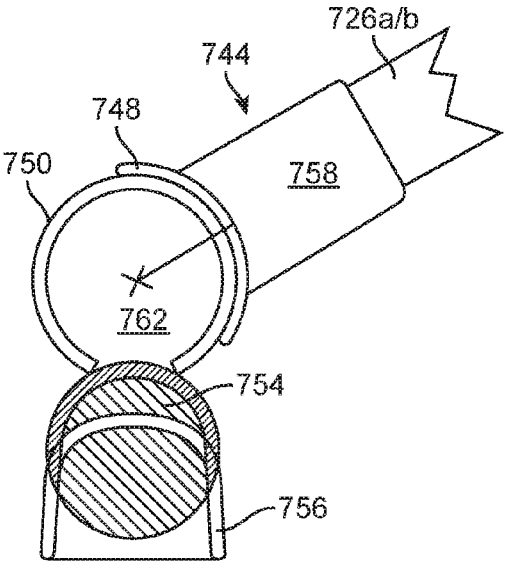
FIG. 7I-1

DEVICE FOR FACILITATING SELF-DRESSING

CROSS-REFERENCE TO RELATED APPLICATIONS

This Application claims the benefit of priority of the U.S. Utility Provisional Patent Application No. 61/926,802 filed on Jan. 13, 2014, the entire disclosures of which is expressly incorporated by reference in its entirety herein. It should be noted that where a definition or use of a term in the incorporated patent applications is inconsistent or contrary to the definition of that term provided herein, the definition of that term provided herein applies and the definition of that term in the incorporated patent applications does not apply.

BACKGROUND OF THE INVENTION

1. Field of the Invention

One or more embodiments of the present invention relates to a device that facilitates and aids in self-dressing and, more particularly, to a self-help device that facilitates and aids in self-dressing lower as well as upper body with single and or multiple articles of clothing with minimal physical motion and coordination (e.g., exertion, bending, squeezing, gripping, twisting etc.).

2. Description of Related Art

Conventional devices that may be used to assist incapacitated people or individuals with limited mobility to help themselves dress are well known and have been in use for a number of years. However, most such devices are complex, (e.g. require squeezing, griping, twisting, and a fairly complex coordination) tiring to use, and are limited in their ability to assist in only dressing the lower body or upper body and with a single article of clothing, such as a sock, per use of the device. If these are dropped on the floor, the user is most often unable to retrieve them.

Accordingly, in light of the current state of the art and the drawbacks to current devices for facilitating self-dressing mentioned above, a need exists for a self-help device that would facilitate and aid in self-dressing the lower as well as the upper body with single and or multiple articles of clothing without assistance and with minimal physical motion and coordination (e.g., exertion, bending, squeezing, gripping, twisting, etc.).

BRIEF SUMMARY OF THE INVENTION

A non-limiting, exemplary aspect of an embodiment of the present invention provides a portable device, comprising:

a base that supports and provides stability for maintaining the portable device in an upright position;

the base defines a workspace for positioning one or more articles of clothing;

a first retainer associated with the base for retaining the one or more articles of clothing within the workspace; and a handle associated with the base;

wherein the workspace is configured to be maneuvered towards a user for wearing of the one or more articles of clothing without assistance and with minimal physical motion and coordination.

Another non-limiting, exemplary aspect of an embodiment of the present invention provides a method for dressing, comprising:

providing a free standing portable device for dressing;

associating an outer wear garment with a first retainer of the device;

associating a next garment to be worn underneath the outer wear garment on top of the outer wear garment with the first retainer;

sliding the device with the associated outer and next garment over feet and legs of user. Then pulling unit and lower garments up to a point that can be easily reached by the user to grasp clothing off of unit and pulled up to waist.

Another non-limiting, exemplary aspect of an embodiment of the present invention provides a method for dressing, comprising:

providing a free standing portable device for dressing;

associating an outer wear garment with a second retainer of the device;

associating a next garment to be worn underneath the outer wear garment combined together under the outer wear garment with the second retainer;

Then grasping the two side poles and raising the garments up and over the head until the garment head hole lines with the users head then lowering the unit until shirt contacts users head.

Such stated advantages of the invention are only examples and should not be construed as limiting the present invention. These and other features, aspects, and advantages of the invention will be apparent to those skilled in the art from the following detailed description of preferred non-limiting exemplary embodiments, taken together with the drawings and the claims that follow.

BRIEF DESCRIPTION OF THE DRAWINGS

It is to be understood that the drawings are to be used for the purposes of exemplary illustration only and not as a definition of the limits of the invention. Throughout the disclosure, the word "exemplary" may be used to mean "serving as an example, instance, or illustration," but the absence of the term "exemplary" does not denote a limiting embodiment. Any embodiment described as "exemplary" is not necessarily to be construed as preferred or advantageous over other embodiments. In the drawings, like reference character(s) present corresponding part(s) throughout.

DETAILED DESCRIPTION OF THE INVENTION

The detailed description set forth below in connection with the appended drawings is intended as a description of presently preferred embodiments of the invention and is not intended to represent the only forms in which the present invention may be constructed and or utilized.

One or more embodiments of the present invention provide a portable, lightweight device 100 that facilitates and aids in self-dressing the lower as well as the upper body with single and or multiple articles of clothing without assistance and with minimal physical motion, and coordination (e.g., exertion, bending, squeezing, gripping, twisting etc.). Almost any adult or youth that may have limited movement or mobility issues may use the one or more embodiments of the present invention. The elderly, disabled, handicapped, wounded, recovering accident victims, post surgery patients and those suffering with a debilitating disease or condition that cannot bend down or raise their arms up high would benefit greatly from the use of the one or more embodiments of the present invention. By aiding users' dress, one or more embodiments of the present invention increase user independence during patient recovery and physical rehabilitation. Additionally, device 100 can also become a valuable tool for a caregiver from burnout, and therapist in occupational therapy so as to help both patient and caregiver. In most instances, the user may sit when pulling up one or more articles of clothing such as under garments and pants to maintain the user's balance and prevent falling, while maintaining user's back upright during use. While still sitting, the users may also put on one or more articles of clothing, combined together, such as a T-shirt, sweater, etc.

Figure 1:
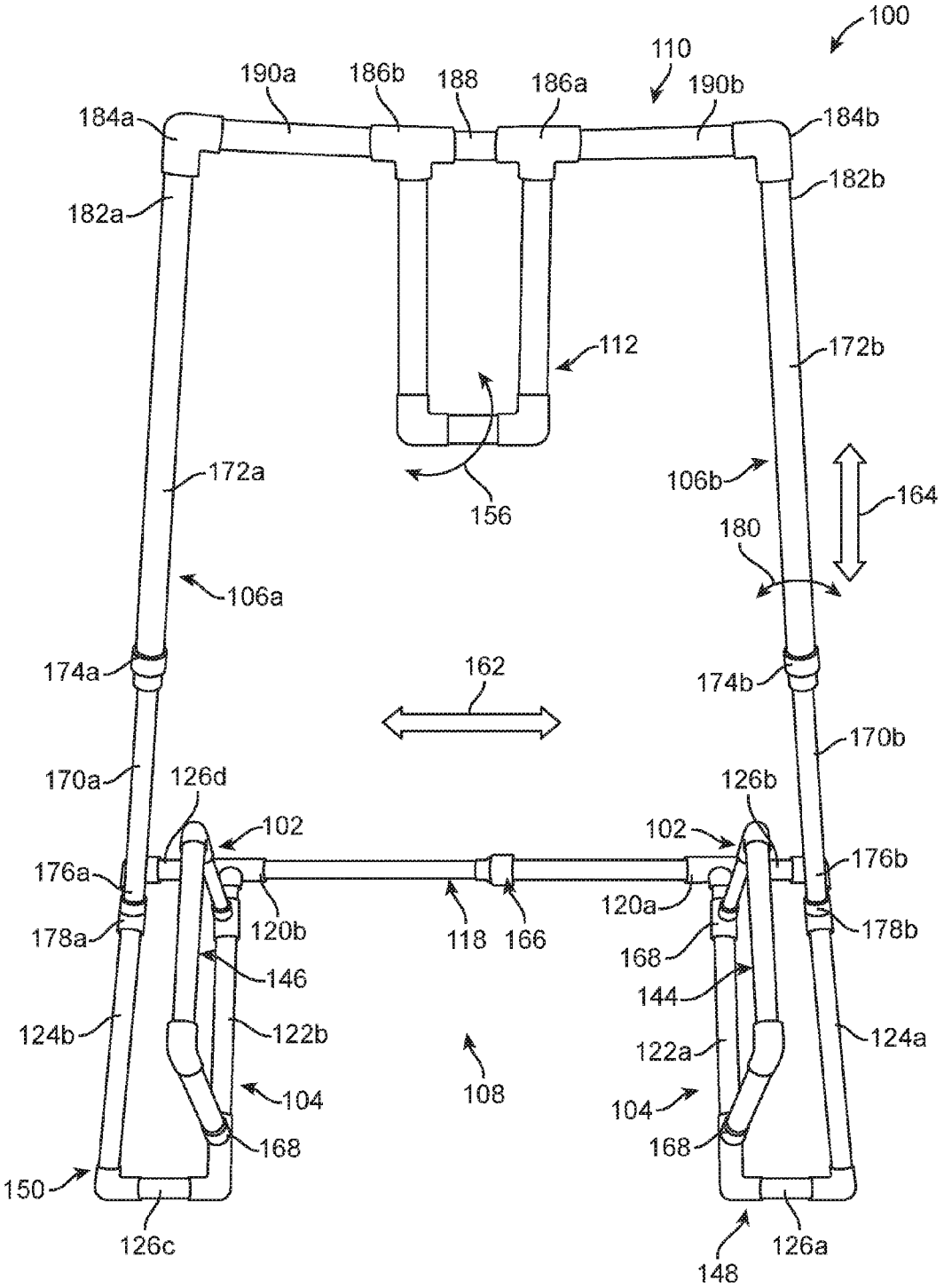
FIG. 1 is a non-limiting, exemplary illustration of a device for facilitating self-dressing in accordance with one or more embodiments of the present invention.

FIG. 1 is a non-limiting, exemplary illustration of a device for facilitating self-dressing in accordance with one or more embodiments of the present invention. As illustrated, one or more embodiments of the present invention provide free-standing, portable device 100, having a base 104 comprised of first and second lateral supports or base halves 148 and 150 that allows device 100 to remain in upright position. Device 100 further includes a first retainer 102 comprised of first and second retainer structures 144 and 146 associated with the base 104 that is used to retain one or more articles of clothing (such as undergarments, pants, etc.) for dressing the lower body. Further included are side poles 106*a* and 106*b* that may function as "handles" associated with base 104 that allows user to actually grasp device 100 and pull-up the one or more articles of clothing without bending. Finally, device 100 also includes a second retainer 110 that includes a movable dressing unit 112 that is used to retain one or more articles of clothing (such as undergarments, T-shirt, shirts, etc.) for dressing the upper body. In this non-limiting, exemplary embodiment, device 100 includes an open workspace 108, which as further detailed below, will not constrict the user's legs once the user has actually mounted one or more articles of clothing on retainer 102, with device 100 being free to move down, and away from the body after use with no interference with the user's legs.

Figure 2A:
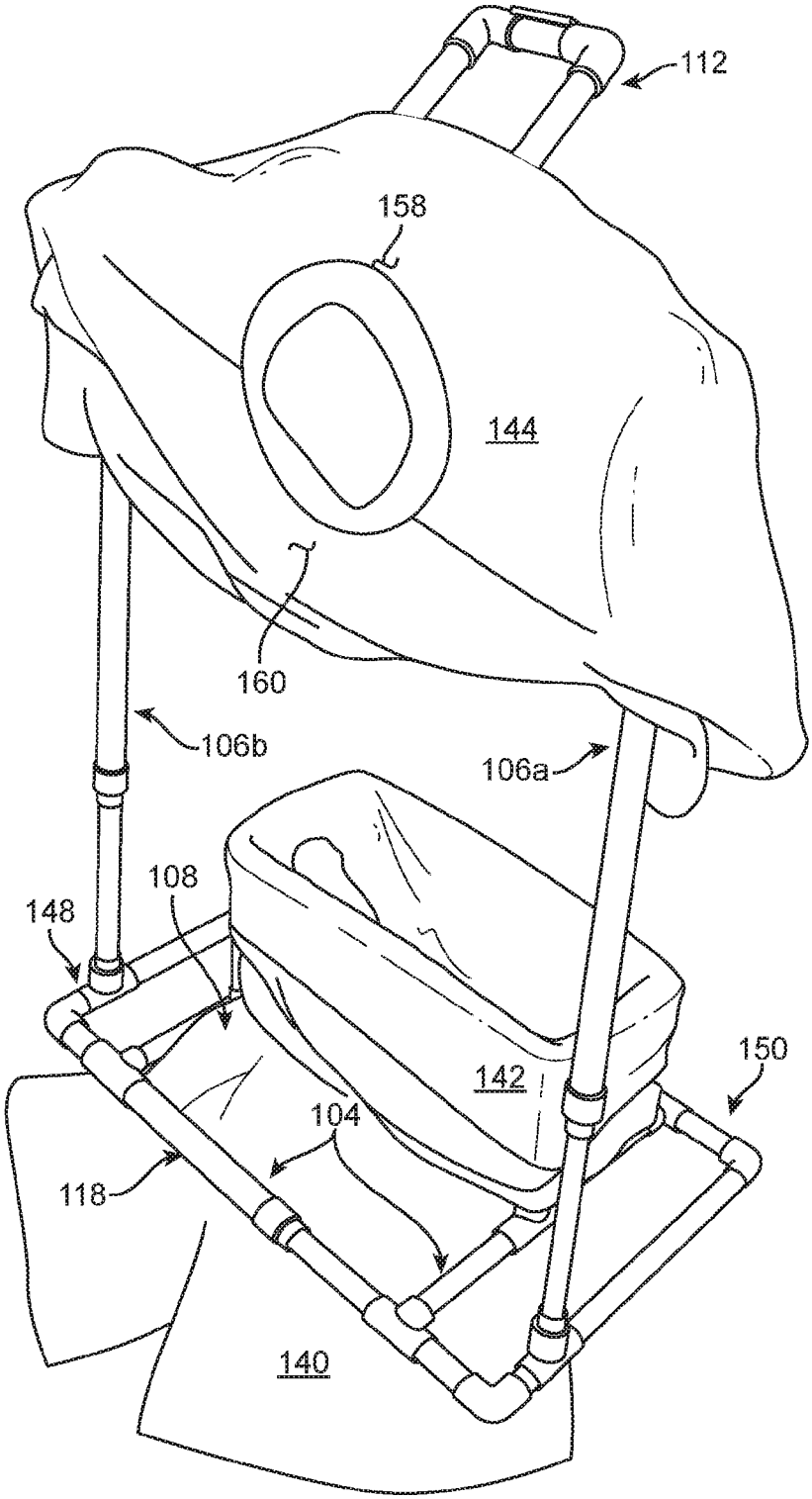
FIG. 2A is a non-limiting, exemplary illustration of the device as shown in FIG. 1, with articles of clothing already mounted thereon in accordance with one or more embodiments of the present invention.

FIG. 2A is a non-limiting, exemplary illustration of device 100, with articles of clothing already mounted thereon in accordance with one or more embodiments of the present invention, and the remaining FIGS. 2B to 2H are non-limiting, exemplary illustrations that progressively illustrate an exemplary method of actually mounting the articles of clothing on device 100 and a method of using the same to aid in dressing. As illustrated in FIG. 2A to 2H, a method for using device 100 to get dressed includes associating an outer wear garment 140 with first retainer 102, and associating a next garment 142 to be worn underneath the outer wear garment 140 on top of the outer wear garment 140 that is already mounted on first retainer 102. As for upper body, a shirt 144 is exemplarily shown associated with second retainer 110 that includes the movable dressing unit 112.

Figure 2B:
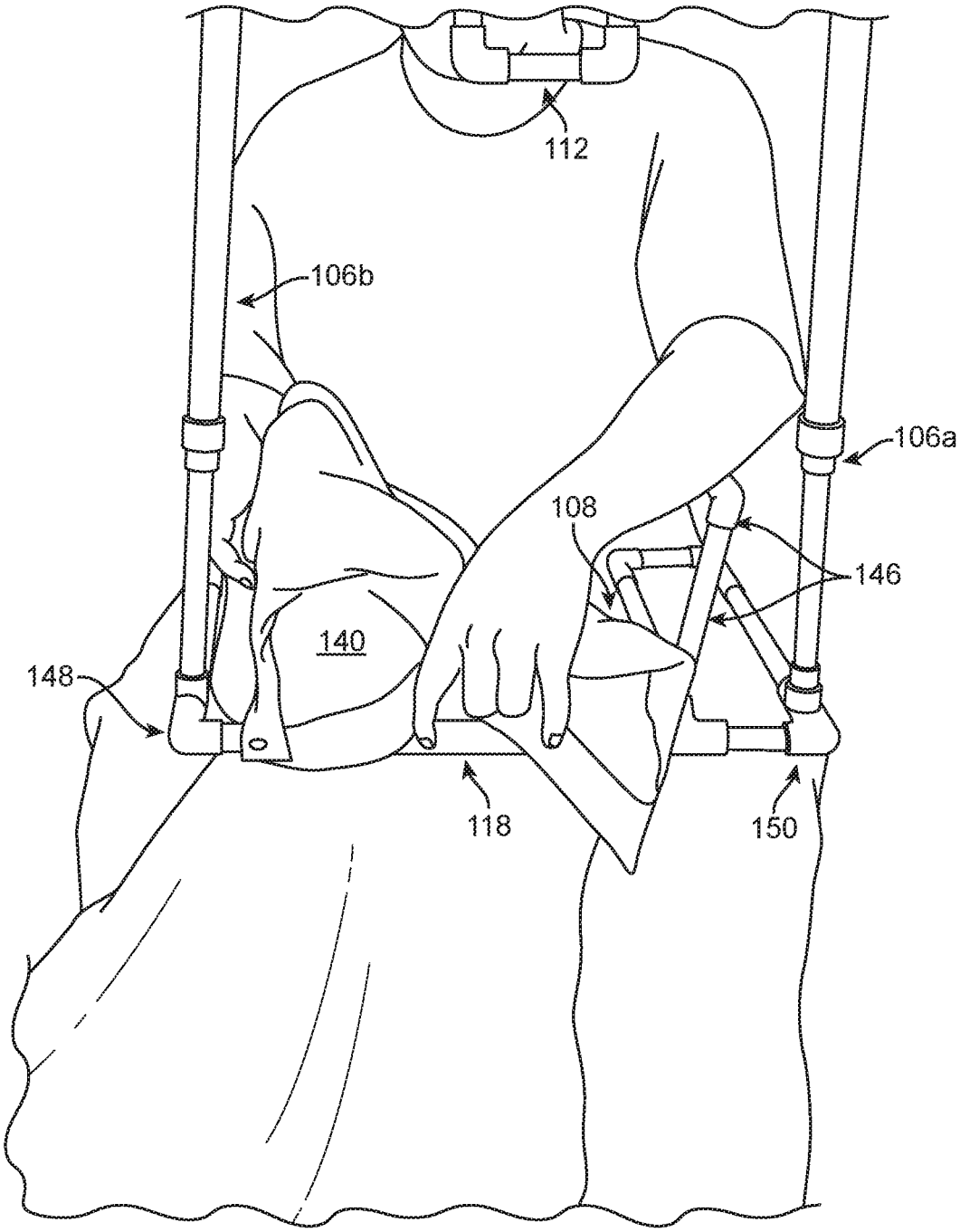
FIGS. 2B to 2H are non-limiting, exemplary illustrations that progressively illustrate an exemplary method of actually mounting the articles of clothing on the device and a method of using the same to aid in dressing.

Referring to FIGS. 2B to 2H, while sitting down, an article of clothing such as pants 140 may first be positioned on the lap of a user in the same manner and orientation as if wearing the pants in a normal manner without any aid, with the leg portion of the pants draped over and hanging down the front of the legs of the user. Multiple clothing may be combined for wearing. Thereafter, device 100 may be positioned so that base 104 rests on top of the user's lap as illustrated in FIG. 2B, with workspace 108 between the base halves 148 and 150 facing the user while a transverse coupler 118 connecting the base halves 148 and 150 positioned away from the user.

Figure 2C:
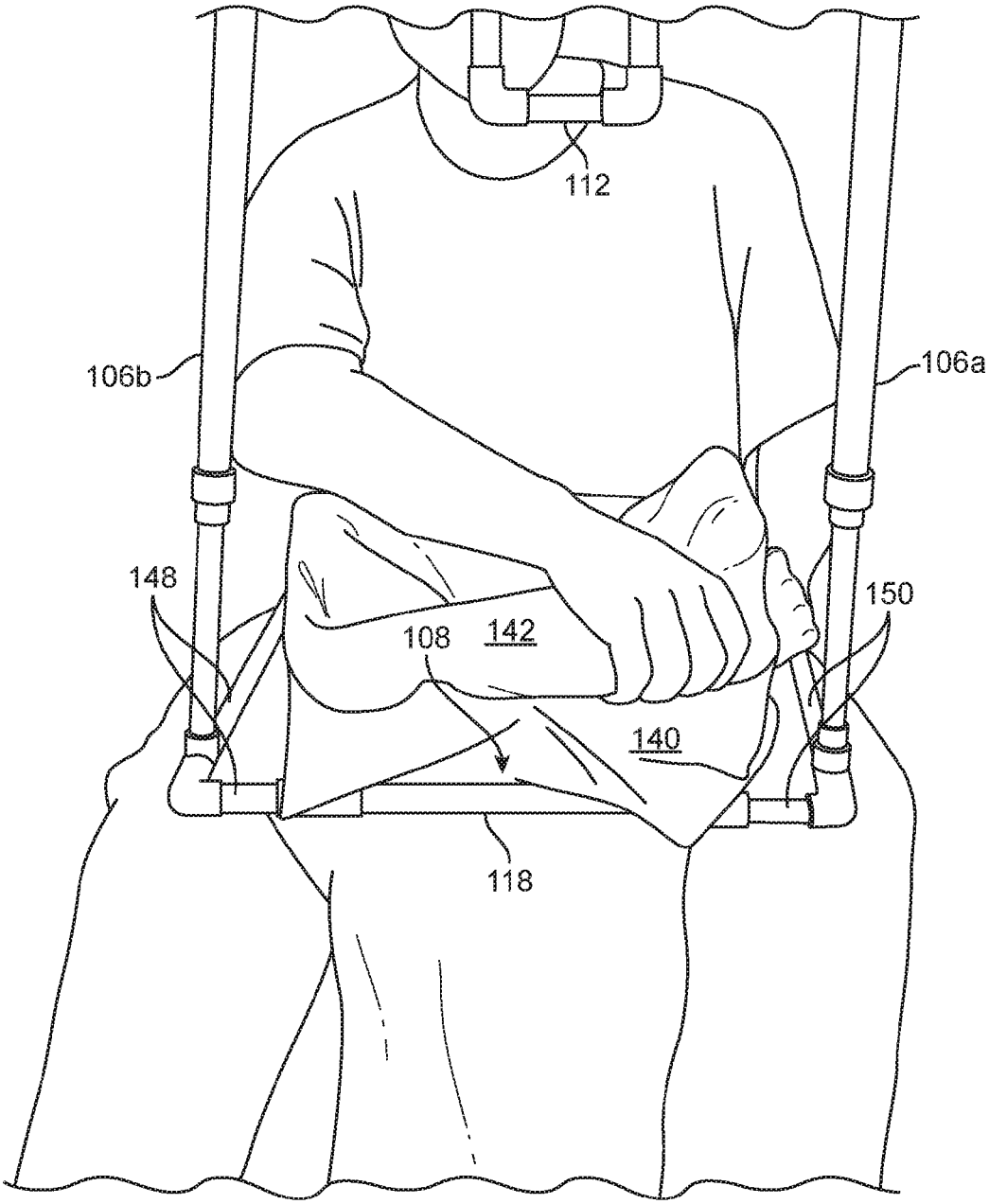

As further illustrated in FIGS. 2B and 2C, to mount one or more articles of clothing 140 and 142 on first retainer 102, a user drapes each side of waistband of the articles of clothing 140 and 142 over respective retainer structures 144 and 146 of first retainer 102 as illustrated without bending or much exertion. To fully secure one or more articles of clothing 140 and 142 onto retainer structures 144 and 146, users may fully pull both sides of the waistbands of the articles of clothing 140 and 142 draped over the retainer structures 144 and 146 down and towards the base halves 148 and 150 until the waistbands touch the base 104. As illustrated, when applying adult undergarment 142, the retainer structures 144 and 146 may be inserted through each leg of adult undergarment 142.

Figure 2D:
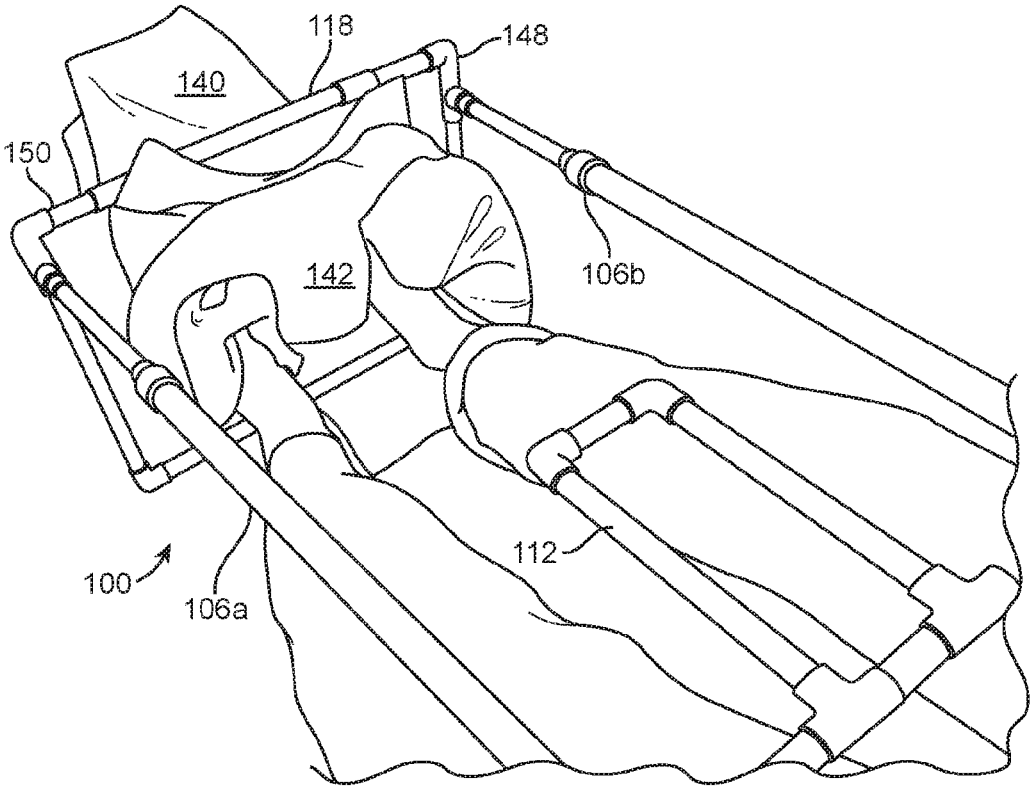
Figure 2E:
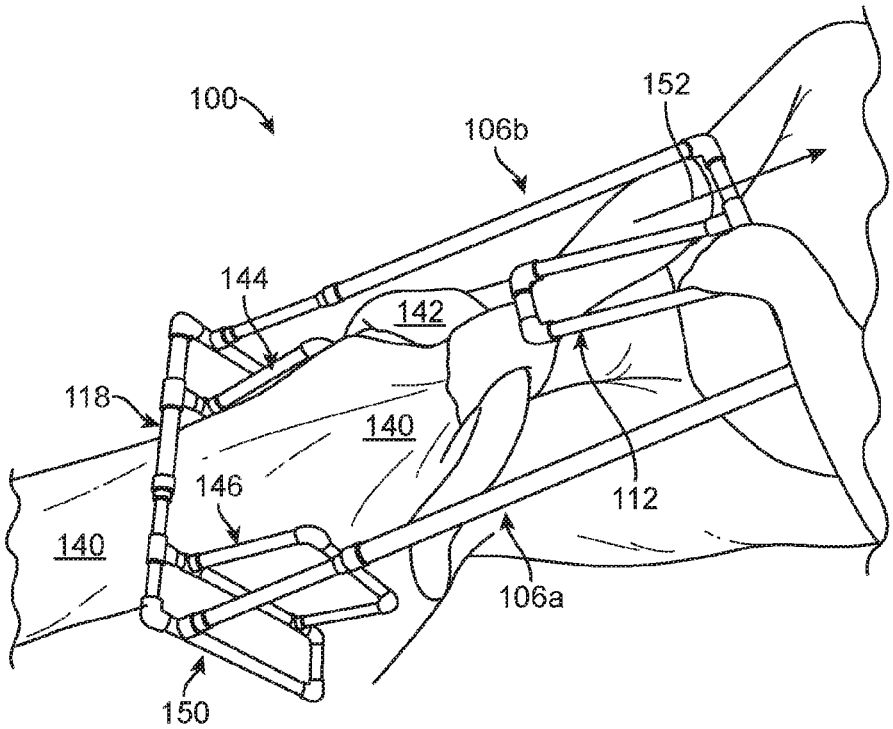
Figure 2F:
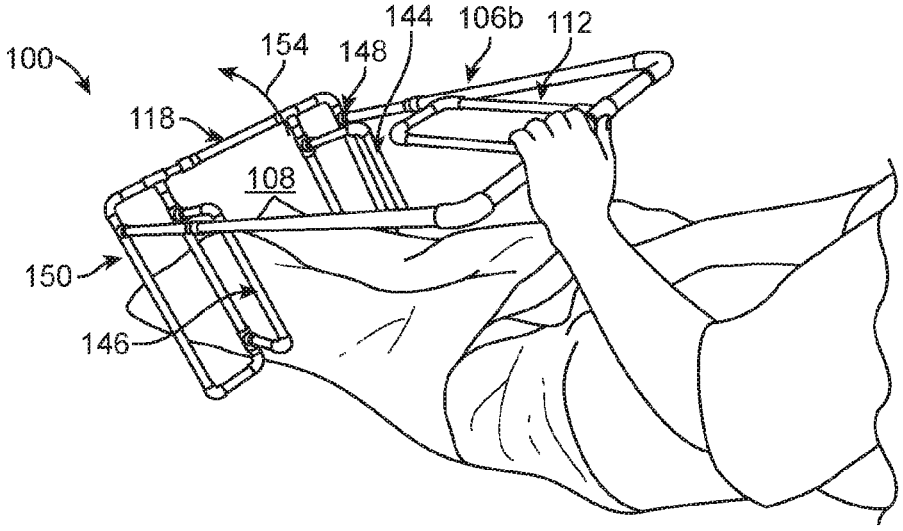
Figure 7A:
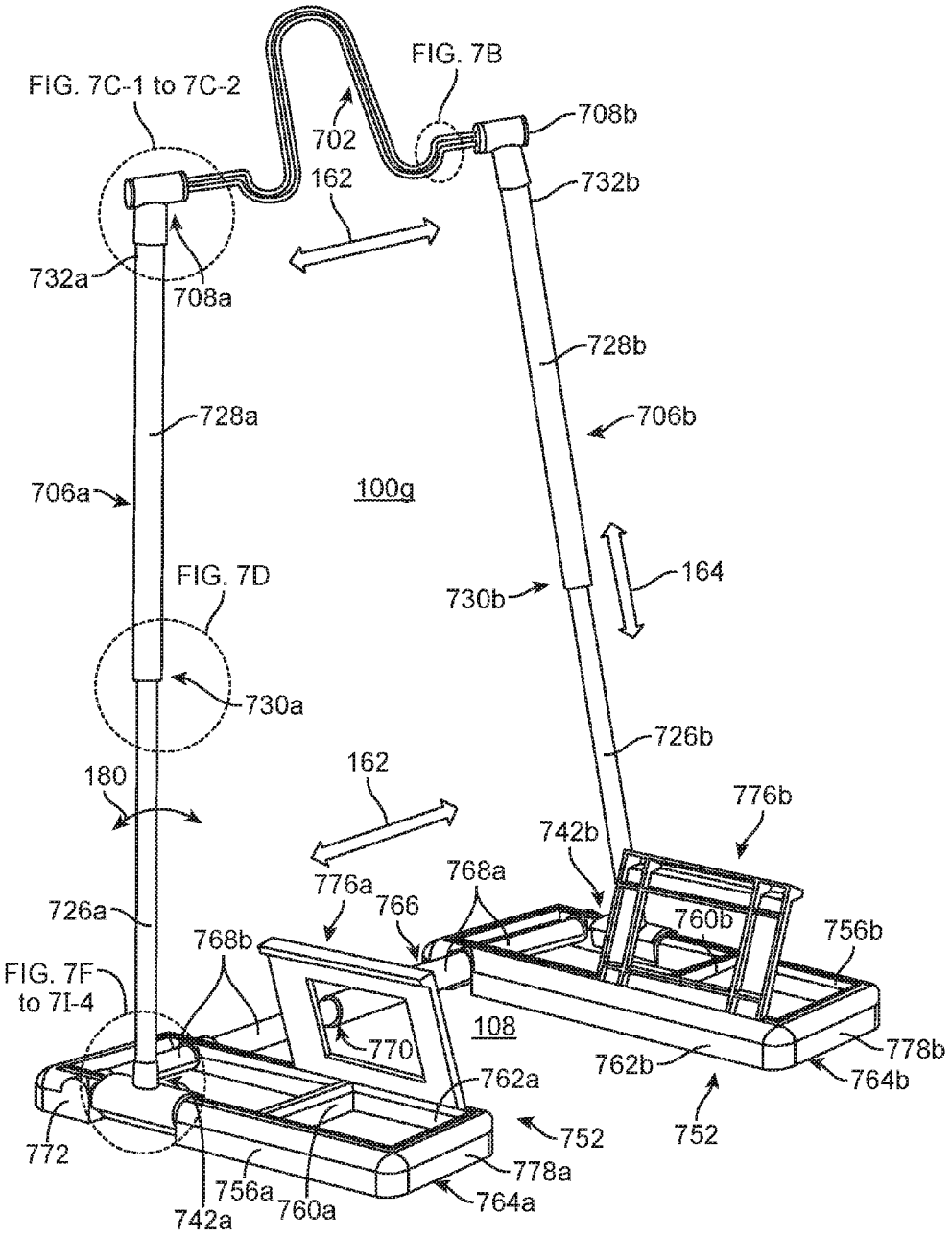
FIGS. 7A to 7R are non-limiting, exemplary illustrations of a device for facilitating self-dressing in accordance with another of one or more embodiments of the present invention.
Figure 7B:
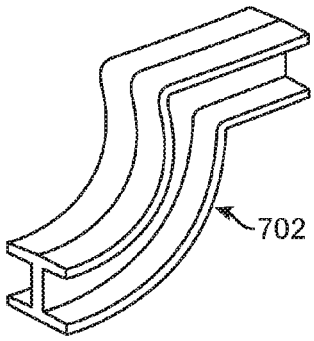
Figures 1, 7C:
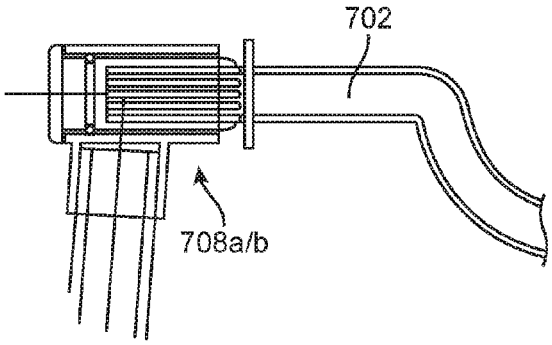
Figures 2, 7C:
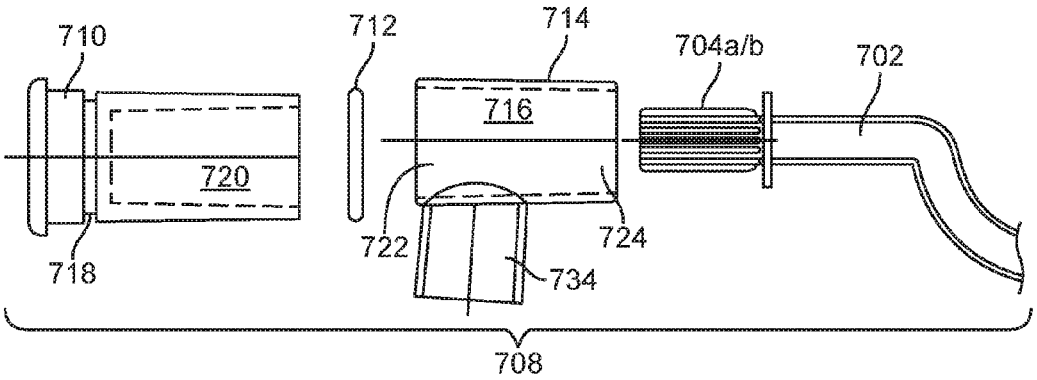

As best illustrated in FIG. 2D, once articles of clothing 140 and 142 are mounted on retainer structures 144 and 146 as illustrated in FIGS. 2, and 2B-2C, device 100 with mounted clothing thereon may be lowered in front of the feet of the user, with the legs of the garment 140 out in front, laid and positioned on the floor as illustrated in FIG. 2D. Users may then position their feet near or inside the leg openings of the one or more articles of clothing 140 and 142 as illustrated in FIG. 2D. Thereafter, device 100 may be raised in the direction indicated by arrow 152 as illustrated in FIG. 2E until the user can comfortably grasp the waistbands of the one or more articles of clothing 140 and 142 (without bending or exertions), and pull them off of the retainer structures 144 and 146. As best illustrated in FIG. 2F, device 100 may be put aside (shown by arrow 154) once one or more articles of clothing 140 and 142 are pulled off device 100, partially worn, and prior to pulling the articles of clothing 140 and 142 to users waist. It should be noted that the orientation of device 100 is critical in that as best illustrated in FIG. 2F, the transverse coupler 118 is away from the user with an open side of workspace 108 accommodating the user legs and therefore, the legs of the users need not be moved or would not interfere when setting aside device 100. It should be noted that retainer structures 144 and 146 retain the garment by stretching the waistband around them and folding them over the outside and down making the garment leg openings stretch open. With the adjustable top handle 106, the user can be sitting down and tilt the lower frame toward themselves to line up their feet with the leg holes of the stretched open garment. When the feet are inserted in the garment leg holes, the user can proceed to raise base 104 and garment toward themselves until the garment is within reach to then grasp the garment and pull it up to their waist. Once the garment is off the frame, device 100 may be laid down and put aside with no actions from the feet or legs because of the open configuration of base 104 front end is open. Therefore, base 104 has an open workspace 108 that prevents device 100 from constricting the user's legs once the user has actually mounted the articles of clothing, with the device 100 being free to move down, and away from the body after use with no interference with the user's legs. In other words, the open base 104 does not trap the user's legs within workspace 108 of base 104. Accordingly, the portable, lightweight device 100 facilitates and aids in self-dressing the lower body with single and or multiple articles of clothing without assistance and with minimal physical motion, and coordination (e.g., seated and without exertion, bending, squeezing, gripping, twisting etc.).

Figure 2G:
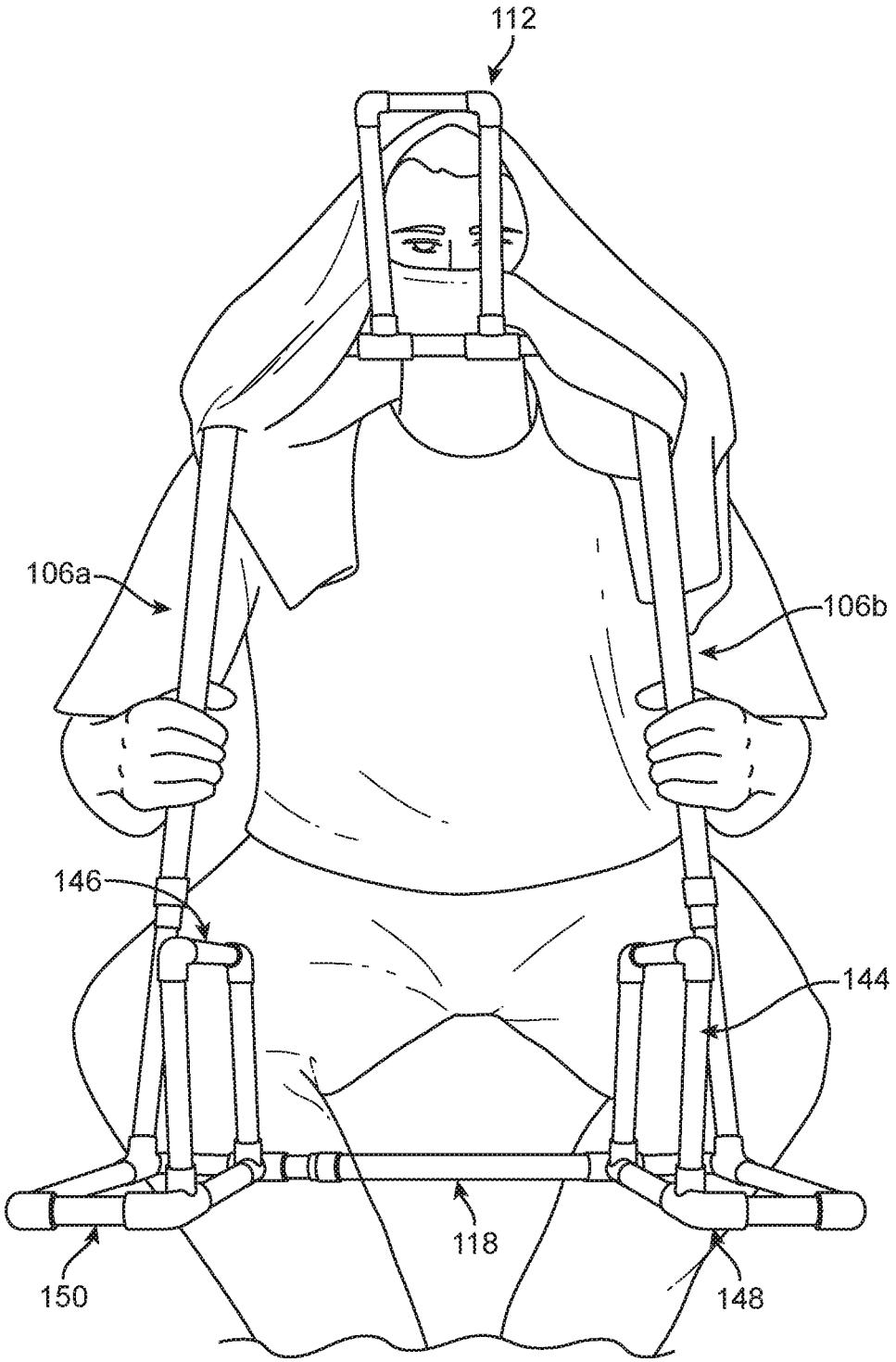
Figure 2H:
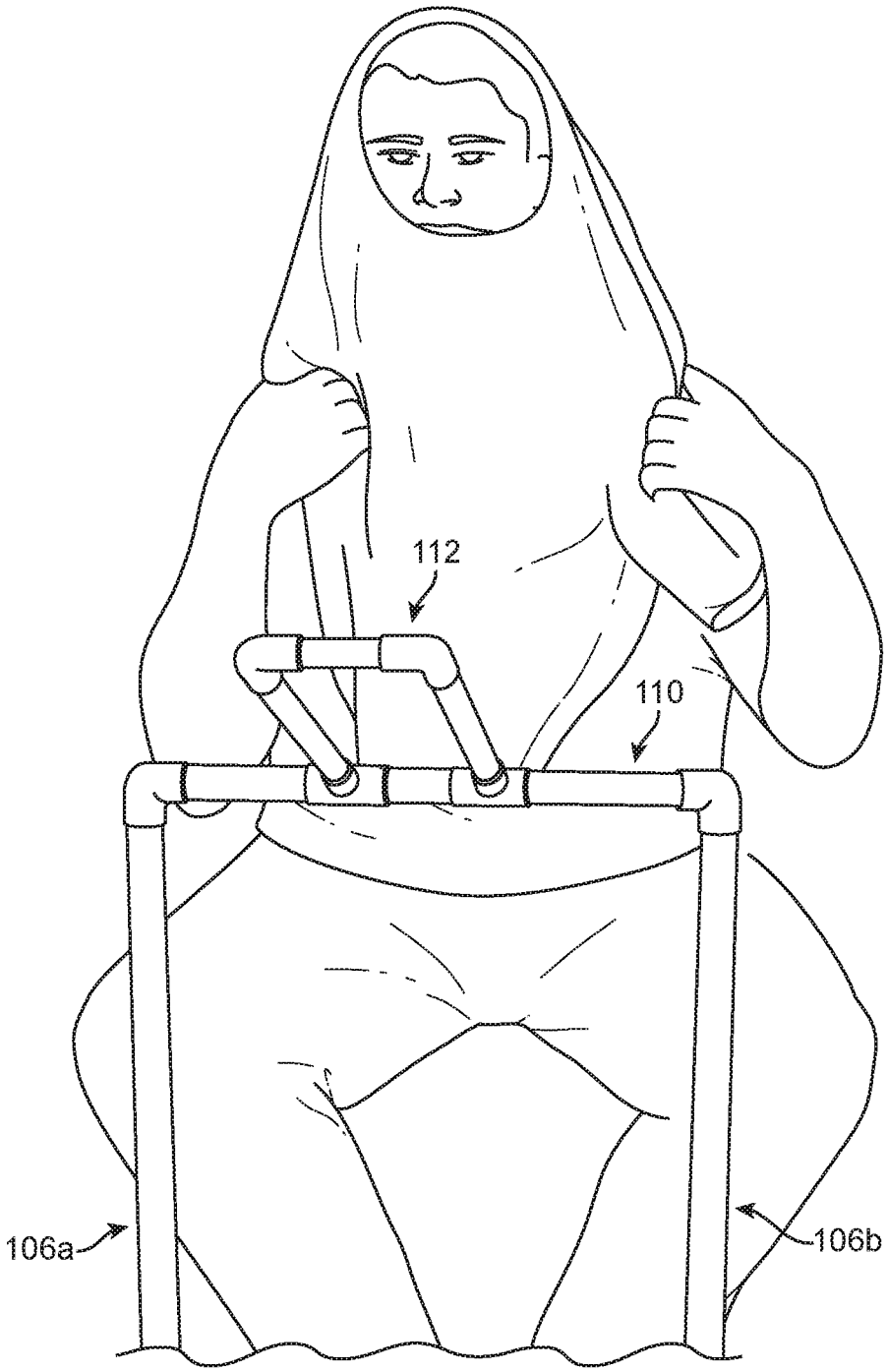

FIGS. 2G and 2H are non-limiting, exemplary illustrations for method of use of device 100 for application of one or more articles of clothing for upper body in accordance with one or more embodiments of the present invention. As detailed below, user's upper arm can just hang down to his/her side and not move, while only his/her elbow and hands bend to apply the garments. The device 100 of the present invention will hold the bottom of a shirt open, raise the shirt over the users head and shoulders, and then lower the shirt over the head while the elbows stay generally affixed to the side. No substantial movement of the shoulders, arms, or back is required. While seated, device 100 may be first placed on the floor (as shown in FIG. 2A), with transverse coupler 118 near the legs of the user (best shown in FIGS. 2G and 2H), which is the opposite orientation of dressing the lower body. Next, dressing unit 112 of second retainer 110 is rotated along a reciprocating path 156 from lower position shown in FIGS. 1, 2D to 2F to an angled position away from the user (shown in FIGS. 2A, 2G, and 2H). As best illustrated in FIG. 2A, thereafter, users may drape a T-shirt or any number of articles of clothing 144 for upper body onto the second retainer 110 where the shoulders of the clothing rest on the second retainer 110 as illustrated and the head hole of the clothing rests at a desired orientation behind the dressing unit 112. While multiple articles of upper clothing are desired to put on with one operation, they should be combined together in the appropriate order before being positioned over dressing unit. When positioned correctly, the second retainer 110 and the dressing unit 112 in particular, maintains the entire front 158 of the clothing 144 at an orientation so that head hole is visible to the user as shown in FIG. 2A.

To facilitate in wearing one or more articles of clothing 144 for upper body, once clothing 144 is correctly position onto device 100, the user may hold the side poles 106*a* and 106*b* as shown in FIG. 2G and raise device 100 over the user head, with back 160 of clothing 144 positioned behind user head until the head hole meets the top of user head. Next, second retainer 110 is slightly moved forward to properly position clothing 144 head hole or collar and continue to lower and remove device 100 from clothing 144. Once the clothing collar is on the user head, the device may be placed aside as shown in FIG. 2H and clothing 144 worn in a normal manner. Accordingly, the portable, lightweight device 100 facilitates and aids in self-dressing the lower as well as upper body with single and or multiple articles of clothing without assistance and with minimal physical motion, and coordination (e.g., seated and without exertion, bending, squeezing, gripping, twisting etc.).

Referring back to FIG. 1 and further detailed below, a height and a width of device 100 (including handle 106 and base 104) are easily adjustable by the resistance transition sliding fittings with no pins or gadgets, for a custom fit to each user. It should be noted that the transition sliding fittings allow one smaller pipe to move through and into the whole length of the other larger pipe and remain at any desired position (frictionally) for a wide range of sizes with no moving parts or obstructions for the patient to deal with.

Base 104 includes first lateral support 148, second lateral support 150, and transverse (or transition slider) coupler 118 associating the first and second lateral supports 148 and 150 with one another. Transverse coupler 118 is associated with first distal ends 120*a* and 120*b* of the first and the second lateral supports 148 and 150 and is adjustable to vary the size of the area of the workspace 108. Transverse coupler 118 may comprise of a variety of mechanisms to enable adjustability, non-limiting, non-exhaustive listing of examples of which may include use of telescopic components or the use of the exemplarily illustrated slip (or expansion) joint 166. Transverse coupler 118 adjustably extends to widen workspace 108 between first and the second lateral supports 148 and 150 and adjustably contracts to decrease the area of workspace 108 between the first and the second lateral support 148 and 150, along path indicated by arrow 162. In other words, transverse coupler 118 is detachably and adjustably associated with a first distal end 120*a* of the first lateral support 148, with a second end of the transverse coupler 118 is detachably and adjustably associated with a first distal end 120*b* of second lateral support 150.

First lateral support 148 and second lateral support 150 of base 104 have minimal expanse (footprint) to cover a sufficient area for supporting portable device 100 in upright position as shown. Lengths of lateral supports 148 and 150 are defined by an outer side 124*a/b* and an inner side 122*a/b*, with inner side 122*a/b* of first lateral support 148 and second lateral support 150 facing the common open area workspace 108. Widths of lateral supports 148 and 150 are defined by first lateral ends 126*a*/126*d* and second lateral ends 126*b*/126*c*. Inner sides 122*a/b* of first and second lateral supports further accommodate a set of mounting points 168 (e.g., "T" fittings) for mounting respective first and second retainer structures 144 and 146 onto first and second inner sides 122*a* and 122*b*.

First retainer (or the garment spreader bars) 102 is comprised of one or more detachably and adjustably retainer structures 144 and 146 for retaining one or more articles of clothing. Retainer structures 144 and 146 are detachably associated with one or both first and second lateral supports 148 and 158 at mounting points 168, and are adjustable in relation to one another and the first and the second lateral supports 148 and 150 to a fixed position. More specifically, retainer structures 144 and 146 are detachably and adjustably associated with inner sides 122*a* and 122*b* of first and second lateral supports 148 and 150 at mounting points 168, adjacent the common, open area of workspace 108. A non-limiting example of the first retainer comprises two riser spreader bars that are outwardly slanted (divergent with respect to one another) at an angle.

First and second side poles 106*a* and 106*b* are comprised of respective first and second lower members 170*a* and 170*b* and respective first and second upper members 172*a* and 172*b* that are joined by a set of slip (or expansion) joints 174*a* and 174*b* that enable the side poles 106*a* and 106*b* to adjustably extend and contract along reciprocating path indicated by arrow 164. Lower ends 176*a* and 176*b* of respective lower members 170*a* and 170*b* are coupled with a outer sides 124*a* and 124*b* of lateral supports 148 and 150 of base 104 by respective lower swivel joints 178*a* and 178*b*, which enable first and second side poles 106*a* and 106*b* to move along reciprocating path indicated by arrow 180. Upper ends 182*a* and 182*b* of respective upper members 172*a* and 172*b* are coupled with second retainer 110 by respective slip and grip "L" shaped joints 184*a* and 184*b*. The dressing unit 112 includes rotatable slip and grip "T" shaped joints 186*a* and 186*b* that are connected by a center bar 188, which enable dressing unit 112 of second retainer 110 to move along reciprocating path indicated by arrow 156. The other ends of the joins 186*a* and 186*b* are coupled with side poles 106*a/b* by a set of bars 190*a/b* as illustrated.

Accordingly, in the embodiment illustrated in FIGS. 1 to 2H, base 104, first retainer 102, handle or side poles 106, and second retainer 110 are detachably and adjustably associated with one another to move, expand, and contract to a desired position and size. Further, each is individually adjustable to move, expand, and contract to a desired position and size, forming an adjustable portable device that adjusts to expand or contract to a desired size. Additionally, each is comprised of one or more detachable and adjustable members or constituent parts or components that are detachably coupled and move, expand, and contract to a desired position and size. It should be noted that a variety of mechanisms may be used to enable adjustability, non-limiting, non-exhaustive listing of examples of which may include use of telescopic components or the use of the exemplarily illustrated slip (or expansion) joints, slip and grip "T" joints, etc.

Figure 3:
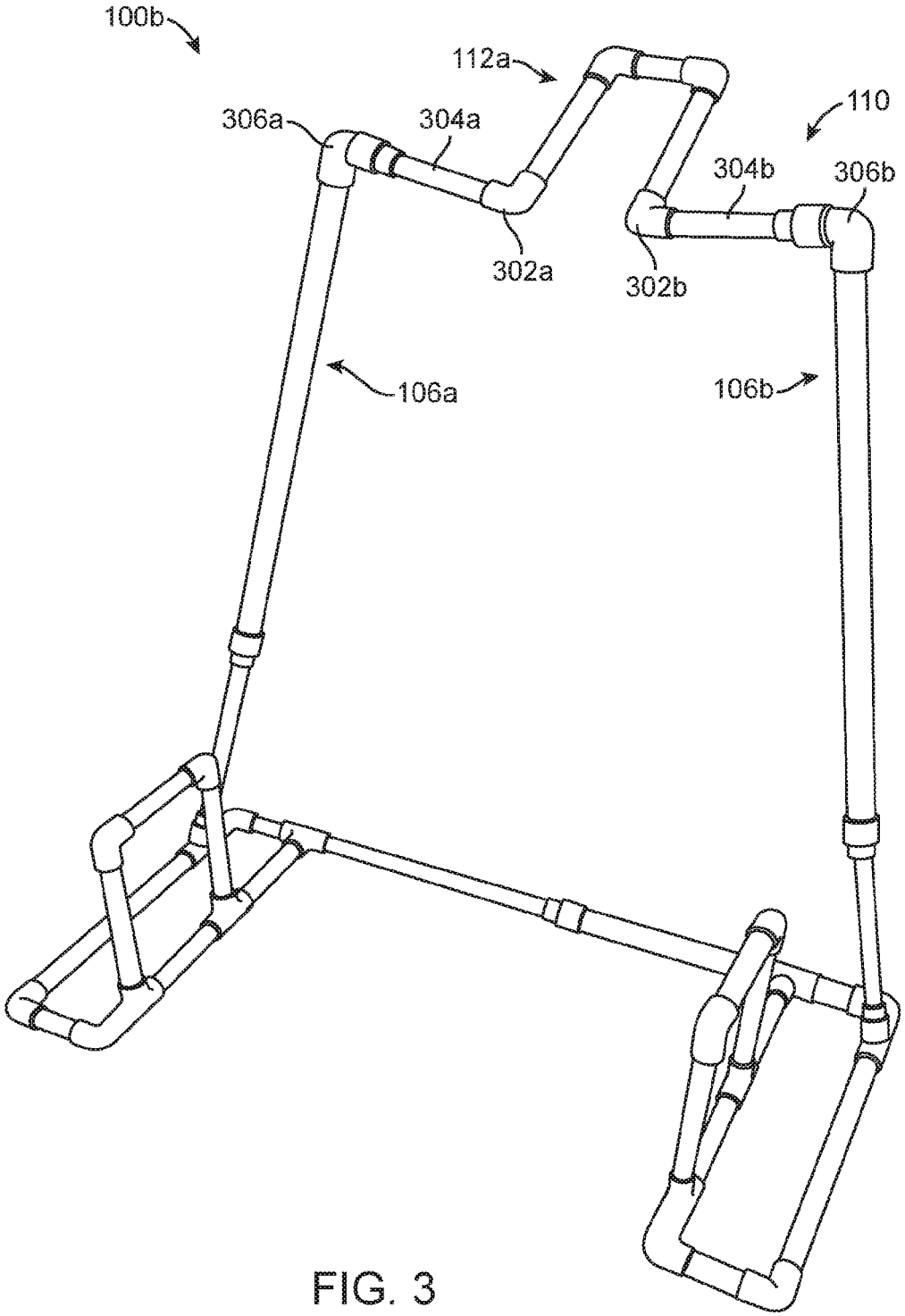
FIG. 3 is a non-limiting, exemplary illustration of a device for facilitating self-dressing in accordance with another of one or more embodiments of the present invention.

FIG. 3 is a non-limiting, exemplary illustration of a device for facilitating self-dressing in accordance with another of one or more embodiments of the present invention. Device 100*b* illustrated in FIG. 3 includes similar corresponding or equivalent components, interconnections, functional, and or cooperative relationships as device 100*a* that is shown in FIGS. 1 to 2H, and described above. Therefore, for the sake of brevity, clarity, convenience, and to avoid duplication, the general description of FIG. 3 will not repeat every corresponding or equivalent component, interconnections, functional, operational, and or cooperative relationships that has already been described above in relation to device 100*a* that is shown in FIGS. 1 to 2H. As illustrated in FIG. 3, in the non-limiting, exemplary embodiment illustrated, rotatable slip and grip "T" shaped joints 186*a* and 186*b* that are connected by a center bar 188 and shown in FIG. 1 are eliminated. Instead, simple "L" shaped joints 302*a* and 302*b* are used to connect dressing unit 112*a* (now with an open side) to the rest of the second retainer 110, with bars 304*a* and 304*b* connected to the side poles 106*a* and 106*b* by swivel joints 306*a* and 306*b*. This modification has the advantage of providing greater flexibility for dressing unit 112*a*, especially when device 100 is widened along path 162.

Figure 4:
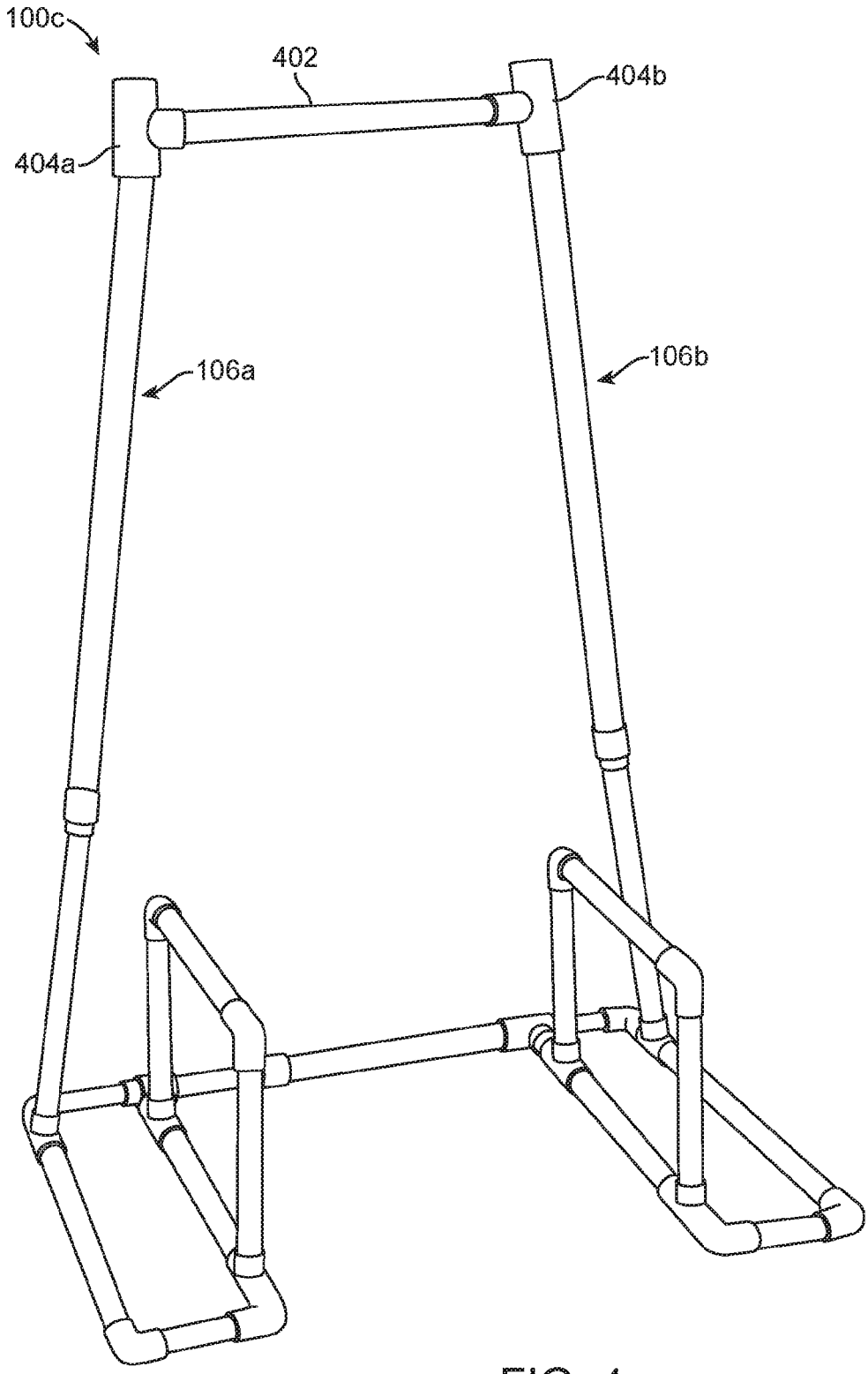
FIG. 4 is a non-limiting, exemplary illustration of a device for facilitating self-dressing in accordance with another of one or more embodiments of the present invention.

FIG. 4 is a non-limiting, exemplary illustration of a device for facilitating self-dressing in accordance with another of one or more embodiments of the present invention. Device 100*c* illustrated in FIG. 4 includes similar corresponding or equivalent components, interconnections, functional, and or cooperative relationships as devices 100*a* and 100*b* that are shown in FIGS. 1 to 3, and described above. Therefore, for the sake of brevity, clarity, convenience, and to avoid duplication, the general description of FIG. 4 will not repeat every corresponding or equivalent component, interconnections, functional, operational, and or cooperative relationships that has already been described above in relation to devices 100*a* and 100*b* that are shown in FIGS. 1 to 3. In the non-limiting, exemplary embodiment illustrated in FIG. 4 for device 100*c*, second retainer 110, including dressing bar 112 is eliminated and replaced by a simple crossbar 402 coupled with the side poles 106*a* and 106*b* via respective set of "T" shaped joints 404*a* and 404*b*.

Figure 5:
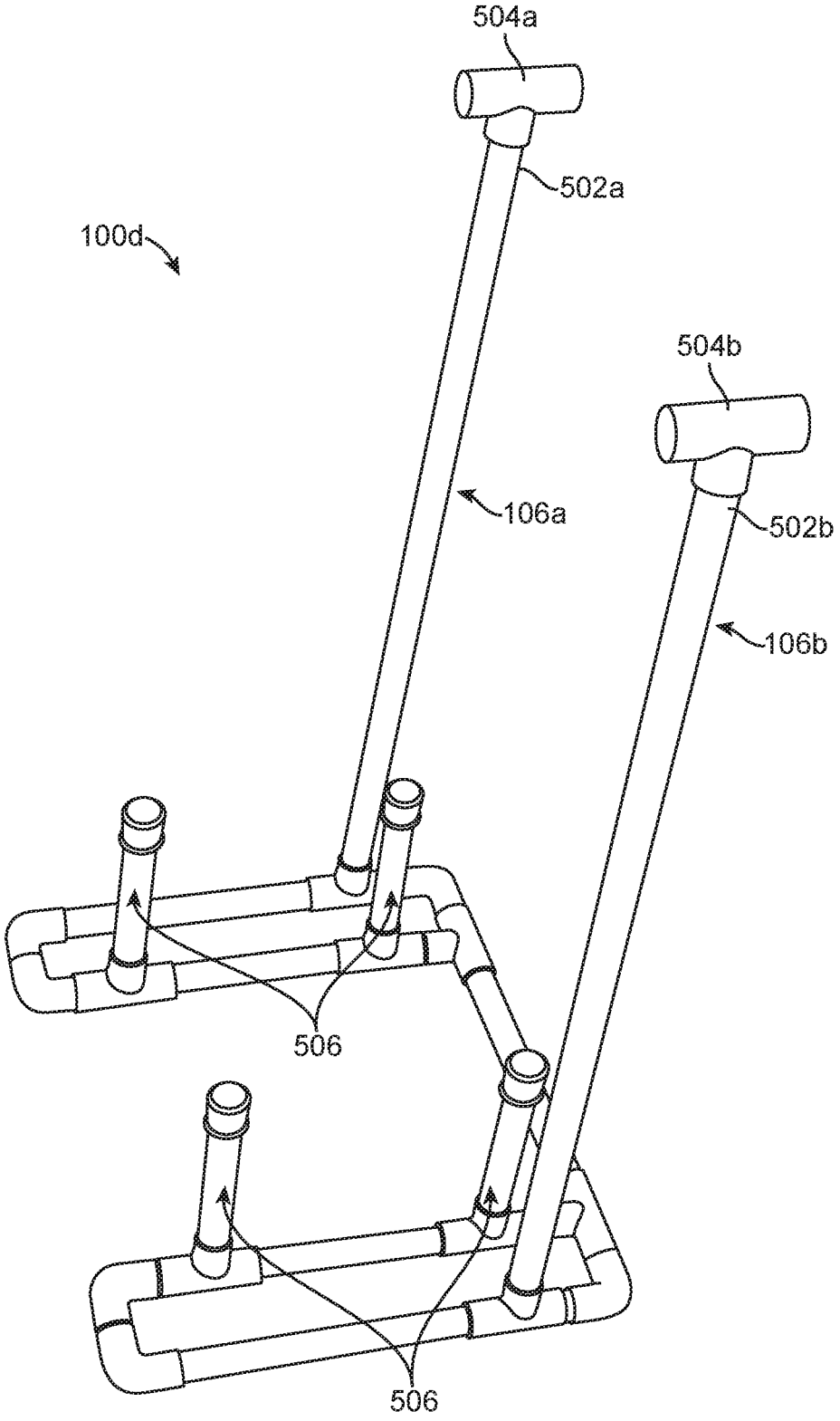
FIG. 5 is a non-limiting, exemplary illustration of a device for facilitating self-dressing in accordance with another of one or more embodiments of the present invention.

FIG. 5 is a non-limiting, exemplary illustration of a device for facilitating self-dressing in accordance with another of one or more embodiments of the present invention. Device 100*d* illustrated in FIG. 5 includes similar corresponding or equivalent components, interconnections, functional, and or cooperative relationships as devices 100*a*, 100*b*, and 100*c* that are shown in FIGS. 1 to 4, and described above. Therefore, for the sake of brevity, clarity, convenience, and to avoid duplication, the general description of FIG. 4 will not repeat every corresponding or equivalent component, interconnections, functional, operational, and or cooperative relationships that has already been described above in relation to devices 100*a*, 100*b*, and 100*c* that are shown in FIGS. 1 to 4. In the non-limiting, exemplary embodiment illustrated in FIG. 5 for device 100*d*, second retainer 110 is eliminated, side poles 106*a* and 106*b* have free ends 502 and 502*b* that are coupled with handles 504*a* and 504*b*. Further, posts 506 replace retainer structures 144 and 146. Additionally, the side poles 106*a* and 106*b* may comprise of a fixed size.

Figure 6A:
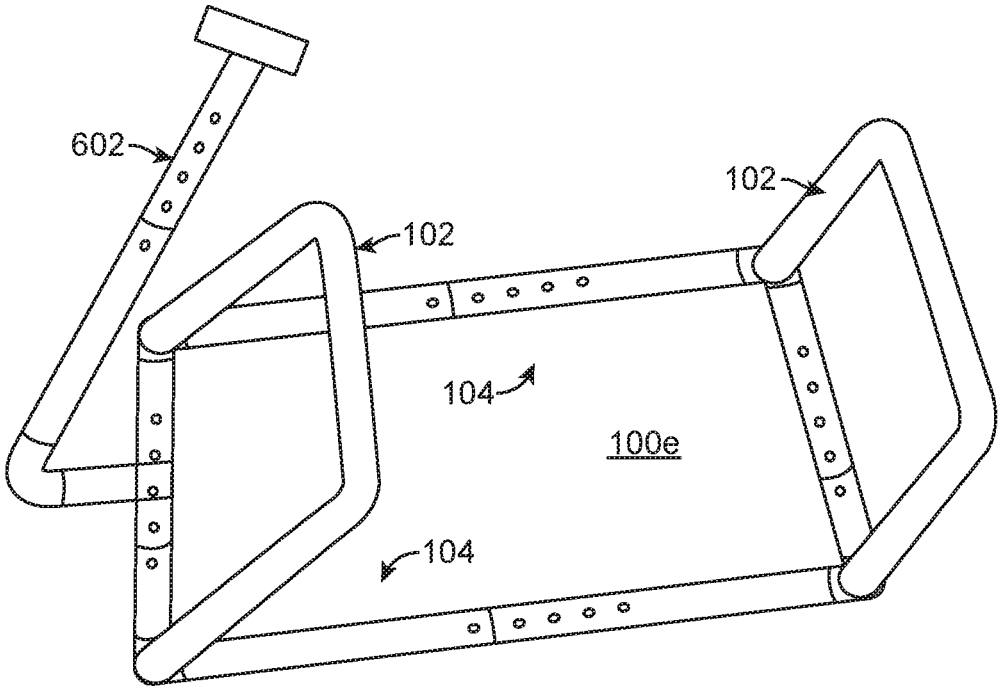
FIGS. 6A and 6B are non-limiting, exemplary illustrations of devices for facilitating self-dressing in accordance with another of one or more embodiments of the present invention.
Figure 6B:
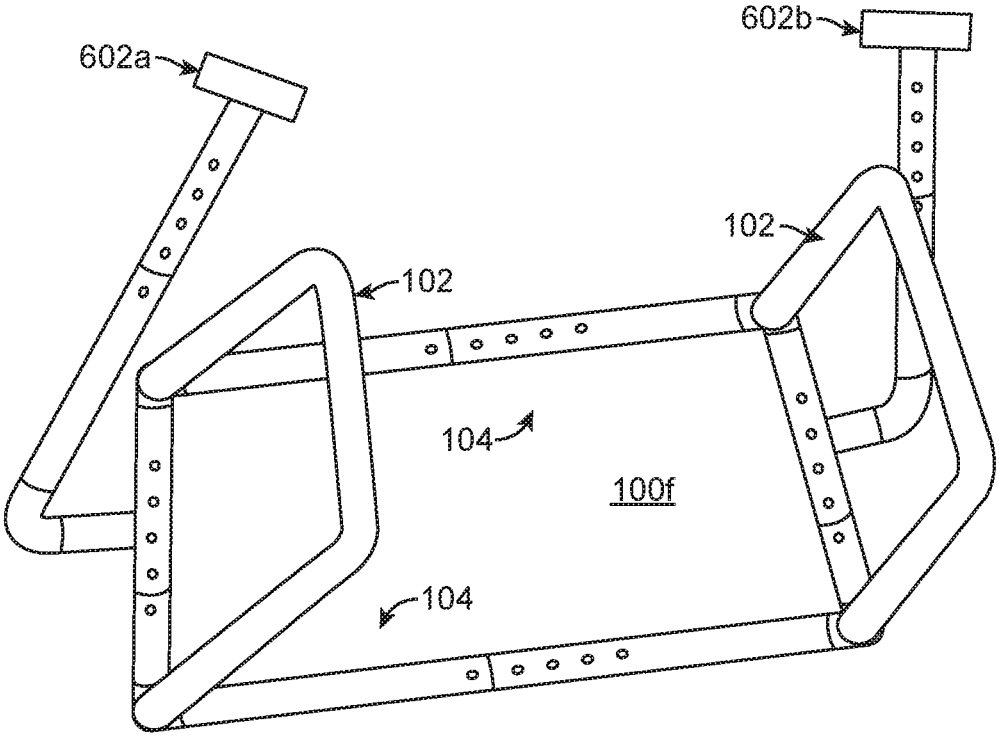

FIGS. 6A and 6B are non-limiting, exemplary illustrations of devices for facilitating self-dressing in accordance with another of one or more embodiments of the present invention. Devices 100*e* and 100*f* illustrated in FIGS. 6A and 6B includes similar corresponding or equivalent components, interconnections, functional, and or cooperative relationships as devices 100*a*, 100*b*, 100*c*, and 100*d* that are shown in FIGS. 1 to 5, and described above. Therefore, for the sake of brevity, clarity, convenience, and to avoid duplication, the general description of FIGS. 6A and 6B will not repeat every corresponding or equivalent component, interconnections, functional, operational, and or cooperative relationships that has already been described above in relation to devices 100*a*, 100*b*, 100*c*, and 100*d* that are shown in FIGS. 1 to 5. Embodiments illustrated in FIGS. 6A and 6B provide portable, lightweight devices 100*e* and 100*f* that facilitate and aid in self-dressing the lower body with a single handle 602 (FIG. 6A) or two handles 602*a* and 602*b* (FIG. 6B). Devices 100*e* and 100*f* maintain their adjustability for base 104, handles 602, 602*a*, 602*b*, and first retainer 102 by "push pins" and slide tubes.

Figure 7D:
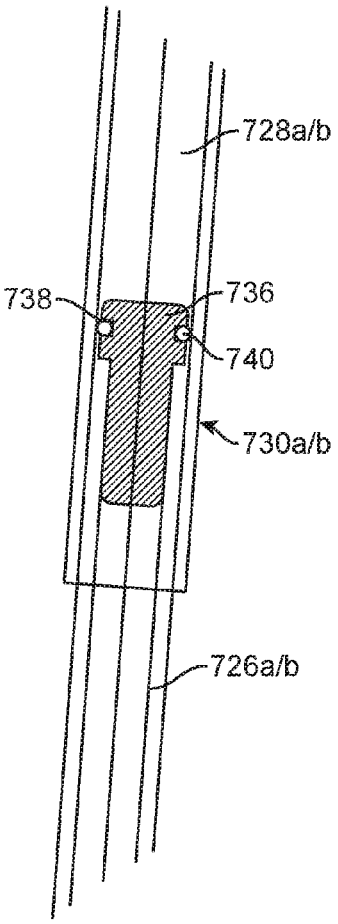
Figure 7E:
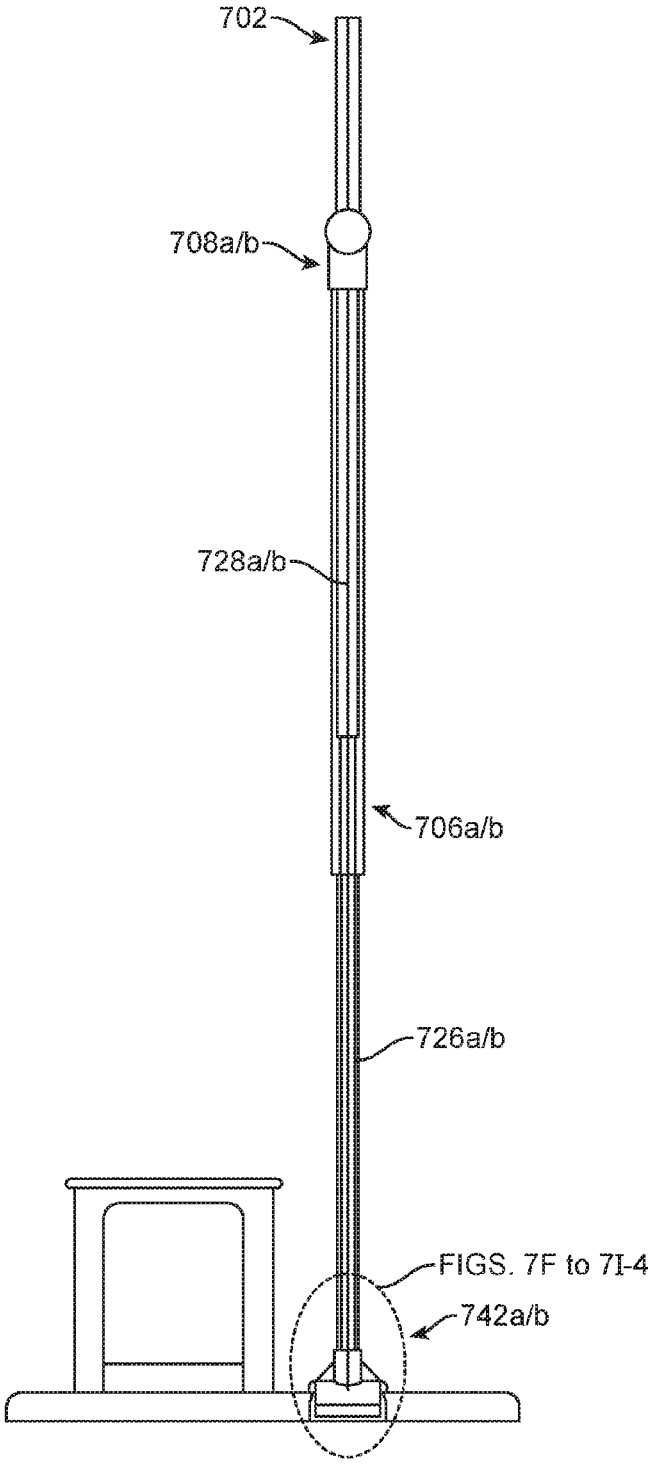
Figures 2, 7I:
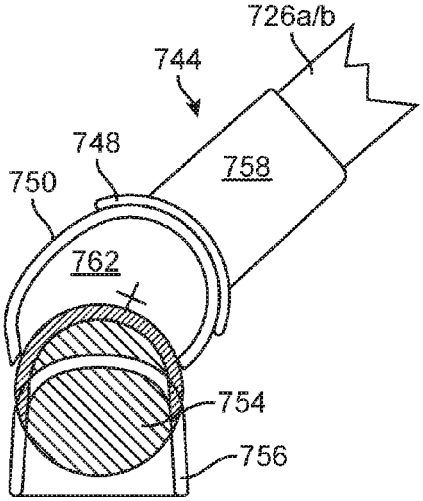
Figures 3, 7I:
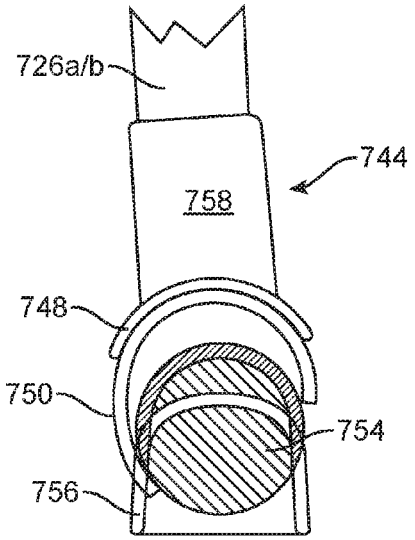
Figures 4, 7I:
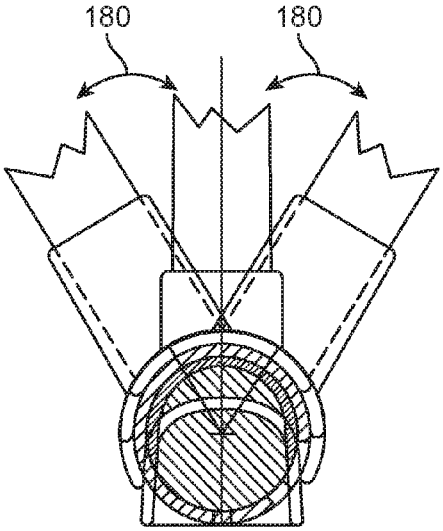
Figure 7J:
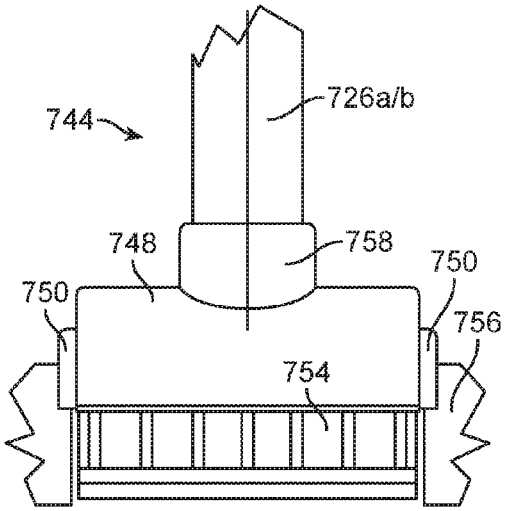
Figures 1, 7K:
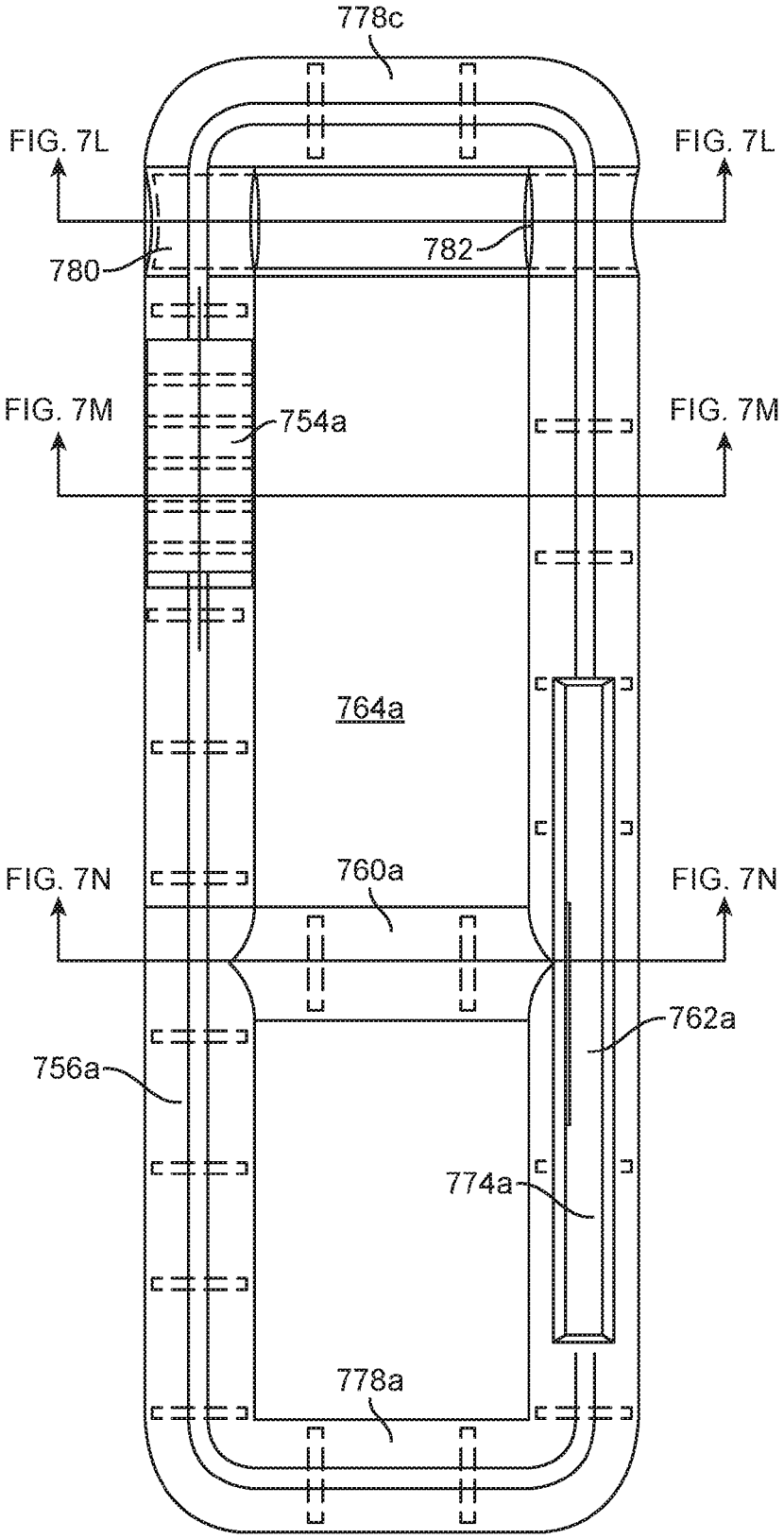
Figures 2, 7K:
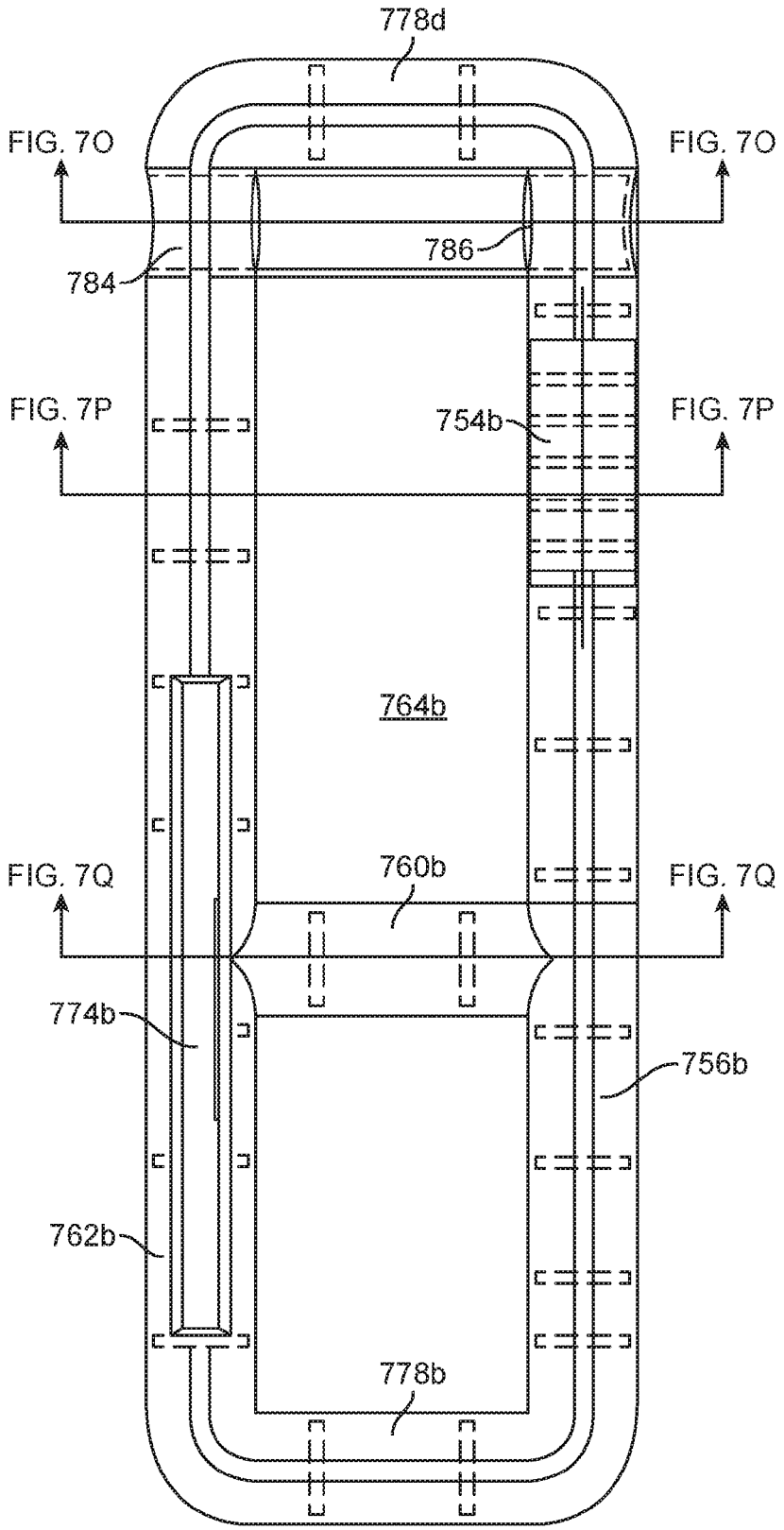
Figure 7L:
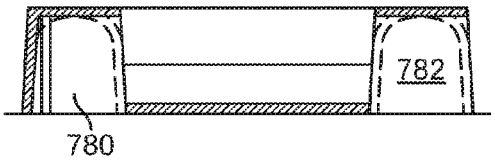
Figure 7O:
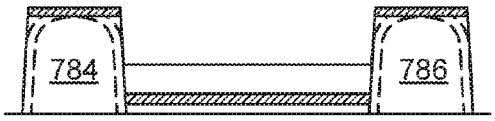
Figure 7M:
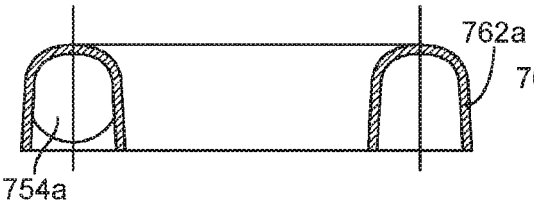
Figure 7P:
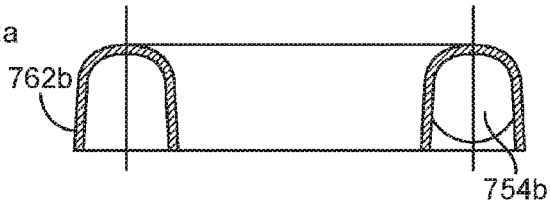
Figure 7N:
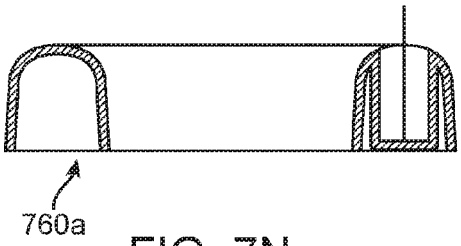
Figure 7Q:
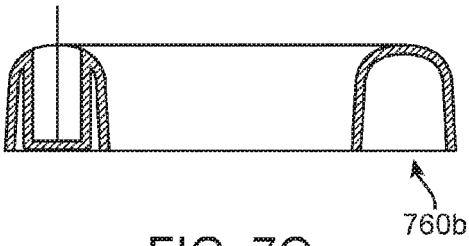
Figure 7R:
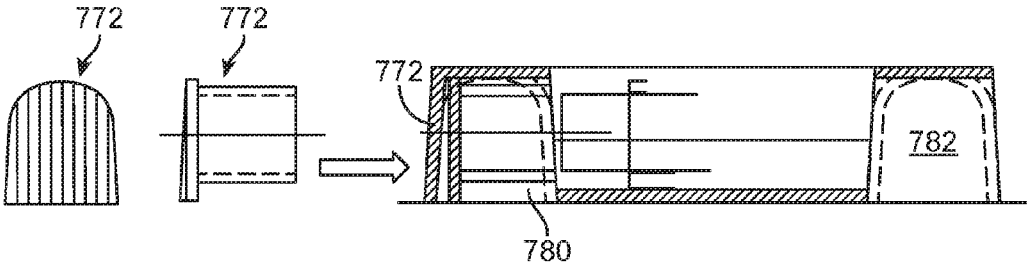

FIGS. 7A to 7R are non-limiting, exemplary illustrations of a device for facilitating self-dressing in accordance with another of one or more embodiments of the present invention. Device 100*g* illustrated in FIGS. 7A to 7R includes similar corresponding or equivalent components, interconnections, functional, and or cooperative relationships as devices 100*a*, 100*b*, 100*c*, 100*d*, 100*e*, and 100*f* that are shown in FIGS. 1 to 6B, and described above. Therefore, for the sake of brevity, clarity, convenience, and to avoid duplication, the general description of FIGS. 7A to 7R will not repeat every corresponding or equivalent component, interconnections, functional, operational, and or cooperative relationships that has already been described above in relation to devices 100*a*, 100*b*, 100*c*, 100*d*, 100*e*, and 100*f* that are shown in FIGS. 1 to 6B.

As illustrated in FIGS. 7A to 7R and in particular, FIGS. 7A and 7B, device 100*g* includes a second retainer 702 comprised of a single piece, adjustable member with an I-beam cross-section for added strength. As best illustrated in FIGS. 7A and 7C-1 and 7C-2, distal ends 704*a* and 704*b* of second retainer 702 are adjustably coupled to side poles 706*a* and 706*b* by adjustable couplers 708*a* and 708*b*, each comprised of a shoulder O-ring plug 710, an O-ring 712, and a pivot coupler 714. O-ring plug 710 includes a groove 718 that accommodates O-ring 712 and has a cavity 720, with the assembled O-ring plug 710 inserted into a through-hole 716 via first opening 722 of the pivot coupler 714. Distal ends 704*a/b* of second retainer 702 are inserted within cavity 720 of O-ring plug 710 via a second opening 724 of pivot coupler 714. Pivot coupler 714 further includes a cavity 734 for receiving free ends 732*a* and 732*b* of upper members 728*a* and 728*b* of side poles 706*a* and 706*b*. The combination of configuration of second retainer 702 and adjustable couplers 708*a* and 708*b* enable second retainer 702 to adjust to move, expand, and contract to a desired position and size.

In this non-limiting, exemplary embodiment, first and second side poles 706*a* and 706*b* are comprised of respective first and second lower members 726*a* and 726*b* and respective first and second upper members 728*a* and 728*b* that are joined by adjustable couplers 730*a* and 730*b* (detailed in FIG. 7D) that enable the side poles 706*a* and 706*b* to adjustably extend and contract along reciprocating path indicated by arrow 164. Upper ends 732*a* and 732*b* of respective upper members 728*a* and 728*b* are coupled with (inserted within cavity 734 of) pivot coupler 714. As best illustrated in FIG. 7D, adjustable coupler 730*a/b* is comprised of an O-ring plug 736 that includes a groove 738 that accommodates an O-ring 740 that enables upper and lower members of side poles 706*a* and 706*b* to move, expand, and contract to desired position.

Lower ends 742*a* and 742*b* of respective lower members 726*a* and 726*b* are each comprised of a swivel end 744 having vertical member 758 that includes a cavity 746 that received a bottom free end of lower members 726*a* and 726*b*, with the swivel end 744 further having a rounded bottom 748 that accommodates a cut-open tubing 750, which is coupled (e.g., by adhesive) to rounded bottom 748 (as illustrated in FIGS. 7I and 7J). As best illustrated in FIGS. 7I to 7J, swivel end 744 and cut-open tubing 750 assembly snap onto base 752 (detailed below), which enable the side poles 706*a* and 706*b* to move along reciprocating path indicated by arrow 180 (best illustrated in FIGS. 7A and 7I-4).

FIGS. 7I-1 to 7I-3 are non-limiting, exemplary illustrations that progressively illustrate a method for assembly of lower end assemblies 742*a/b* with base 752. As illustrated, cut-open tubing 750 includes a cutout portion 760 and a relief 762, with the cut-out portion 760 flexibly expanding as lower ends 742*a/b* are pressed downward onto swivel base portion 754. As the cutout portion 760 is resiliently widened swivel base portion 754 is inserted through the widened portion 760 by exertion of a force. The cut-out portion 760 is resiliently returned to original size when the swivel base portion 754 has passed through opening 760 and is accommodated inside relief 762, with relief 762, relieving the compressive and tensile forces to allow cut-open tubing 750 to return to its original configuration, and also to prevent swivel base portion 754 from moving out of the relief 760 (movably securing lower end assemblies 742*a/b* onto base 752 as illustrated in FIGS. 7A and 7I-4).

FIGS. 7K-1 to 7R are non-limiting, exemplary illustrations of base 752 of device 100*g* in accordance with an embodiment of the present invention. As illustrated in FIGS. 7A and 7K-1 to 7R, base 752 is comprised of first and second lateral supports or base halves 764*a* and 764*b* that allows device 100*g* to remain in upright position. Device 100*g* further includes a first retainer comprised of first and second retainer structures 776*a* and 776*b* associated with the base 752 at an angle used to retain one or more articles of clothing (such as undergarments, pants, etc.) for dressing the lower body.

As illustrated in FIG. 7A, base 752 includes first lateral support 764*a*, second lateral support 764*b*, and transverse coupler 766 associating first and second lateral supports 764*a* and 764*b* with one another. Transverse coupler 766 is comprised of a first member 768*a* (the lower cross tube) that is associated with a second member 768*b* (lower slip tube) by an adjustable coupler that is identical to the adjustable coupler 730*a/b*, best illustrated in FIG. 7D. In general, in this non-limiting, exemplary instance, the first member 768*a* has a wider diameter than second member 768*b*, with the adjustable coupler enabling second member 768*b* to slip into and out of first member 768*a* to thereby adjust the overall length of transverse coupler 766 to an extended or collapsed positions, which increases or decreases the overall area of the workspace 108. It should be noted that second retainer 702 would also flex (along path 162) to expand or contract as transverse coupler 766 adjustably extends or contracts.

As illustrated in FIGS. 7A and 7K-1 to 7R, lengths of lateral supports 764*a* and 764*b* are defined by an outer side 756*a/b* and an inner side 762*a/b*, with inner side 762*a/b* of first lateral support 764*a* and second lateral support 764*b* facing the common open area workspace 108. Widths of lateral supports 148 and 150 are defined by first lateral ends 778*a/b* and second lateral ends 778*c/d*. Inner sides 762*a/b* of first and second lateral supports 764*a/b* further accommodate openings 774*a/b* for "snap" mounting respective first and second retainer structures 776*a* and 776*b* onto first and second inner sides 762*a/b*. In this non-limiting, exemplary instance, lateral supports 764*a* and 764*b* further include strengthening infrastructure 760*a/b* that transversally span across to connect inner and outer sides 762*a/b* and 756*a/b* of the lateral supports 764*a/b*, improving the overall structural integrity of base 752. Lateral supports 764*a/b* further include transversally oriented holes 780, 782, 784, 786 that enable insertion and movement of transversal coupler 760. The opening 786 is a cavity with outer side 756*b* closing off the opening to form the cavity, where as opening 780 is open at both ends, but is capped by a cover 772 (best illustrated in FIG. 7R).

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Further, the specification is not confined to the disclosed embodiments. Therefore, while exemplary illustrative embodiments of the invention have been described, numerous variations and alternative embodiments will occur to those skilled in the art. For example, the transverse or transition slider coupler may include a detectably and adjustably third holder for facilitating wearing a sock. As another example, the various embodiments of the device may be manufactured of a sufficiently rigid, yet lightweight material, such as aluminum, to allow the user to then use the structure as a foundation to grasp onto in standing and maintenance of balance. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) is not used to show a serial or numerical limitation but instead is used to distinguish or identify the various members of the group.

In addition, any element in a claim that does not explicitly state "means for" performing a specified function, or "step for" performing a specific function, is not to be interpreted as a "means" or "step" clause as specified in 35 U.S.C. Section 112, Paragraph 6. In particular, the use of "step of," "act of," "operation of," or "operational act of" in the claims herein is not intended to invoke the provisions of 35 U.S.C. 112, Paragraph 6.

What is claimed is:

1. A portable device, comprising:

a base that supports and provides stability for maintaining the portable device in an upright position;

the base defines a workspace for positioning one or more articles of clothing;

the base includes at least two lateral supports defining the workspace therebetween;

the at least two lateral supports are joined at a first end by a transverse coupler that is configured as an adjustable bar;

a first retainer associated with the base for retaining the one or more articles of clothing within the workspace; and a handle associated with the base;

wherein the workspace is configured to be maneuvered towards a user for wearing of the one or more articles of clothing without assistance and with minimal physical motion.

2. The portable device as set forth in claim 1, further comprising:

a second retainer that is associated with the handle.

3. The portable device as set forth in claim 2, wherein:

the base, the first retainer, the handle, and the second retainer are detachably and adjustably associated with one another to move, expand, and contract to a desired position and size.

4. The portable device as set forth in claim 2, wherein:

the base, the first retainer, the handle, and the second retainer are individually adjustable to move, expand, and contract to a desired position and size, forming an adjustable portable device that adjusts to expand or contract to a desired size.

5. The portable device as set forth in claim 1, wherein:

the first retainer is comprised of one or more detachable and adjustable retaining structures for retaining the one or more articles of clothing and to move, expand, and contract to a desired position and size.

6. The portable device as set forth in claim 1, wherein:

the first retainer is comprised of one or more detachably and adjustably retaining structures for retaining one or more articles of clothing within the workspace at a desired position;

with a first retaining structure of the one or more retaining structures detachably and adjustably associated with a first lateral support of the at least two lateral supports, and a second retaining structure of the one or more retaining structures detachably and adjustably associated with a second lateral support of the at least two lateral supports; and with the retaining structures adjustable in relation to one another and the at least two lateral supports.

7. The portable device as set forth in claim 1, wherein:

the base includes:

a first lateral support;

a second lateral support; and a transverse coupler associating the first and second lateral supports;

with the first and second lateral supports and transverse coupler defining the workspace.

8. The portable device as set forth in claim 7, wherein:

the transverse coupler is associated with a first distal ends of the first and the second lateral supports.

9. The portable device as set forth in claim 7, wherein:

the transverse coupler is adjustable in relation to at least one of the first and the second lateral supports.

10. The portable device as set forth in claim 7, wherein:

the transverse coupler adjustably expands to increase the workspace between the first and the second lateral supports and adjustably contracts to reduce the workspace between the first and the second lateral support.

11. The portable device as set forth in claim 7, wherein:

a first end of the transverse coupler is detachably and adjustably associated with a first distal end of the first lateral support, with a second end of the transverse coupler detachably and adjustably associated with a first distal end of the second lateral support.

12. The portable device as set forth in claim 7, wherein:

the first lateral support and the second lateral support of the base include:

a length; and a width;

with the length and the width having minimal span to cover a sufficient area for supporting the portable device in a free standing, upright position;

the length defined by an outer side and an inner side, with the inner side of the first lateral support and the second lateral support facing a common open area, defining the workspace; and the width is defined by a first lateral end and a second lateral end, with the first lateral end positioned at a front of the portable device and the second lateral end positioned at back of the portable device.

13. The portable device as set forth in claim 1, wherein:

the first retainer is comprised of one or more retaining structures for retaining one or more articles of clothing.

14. The portable device as set forth in claim 1, wherein:

the first retainer is comprised of one or more detachably and adjustably retaining structures for retaining one or more articles of clothing.

15. The portable device as set forth in claim 13, wherein:

the retaining structures are detachably associated with one or both first and second lateral supports; and the retaining structures are adjustable in relation to one another and the first and the second lateral supports.

16. The portable device as set forth in claim 1, wherein:
the handle includes a first free end, and a second end that is coupled with a transverse coupler.

17. The portable device as set forth in claim 1, wherein:
the handle includes free ends coupled with at junction of outer sides of first and second lateral supports and a transverse coupler.

18. A portable device, comprising:
a base that supports and provides stability for maintaining the portable device in an upright position;
the base defines a workspace for positioning one or more articles of clothing;
the base includes at least two lateral supports defining the workspace therebetween;
the at least two lateral supports are joined at a first end by a transverse coupler that is configured as an adjustable bar;
a first retainer associated with the base for retaining the one or more articles of clothing within the workspace;
a second retainer that is associated with a handle; and
a first and second side posts adjustably and moveably associated with the base;
wherein the workspace is configured to be maneuvered towards a user for wearing of the one or more articles of clothing without assistance and with minimal physical motion.

19. The portable device as set forth in claim 18, wherein:
the base, the first and second retainer, and the first and second side posts are detachably and adjustably associated with one another to move, expand, and contract to a desired position and size.

20. The portable device as set forth in claim 18, wherein:
the base, the first and second retainer, and the first and second side posts are individually adjustable to move, expand, and contract to a desired position and size, forming an adjustable portable device that adjusts to expand or contract to a desired size.

21. A portable device, comprising:
a base that supports and provides stability for maintaining the portable device in an upright position;
a handle associated with the base; and
a retainer that is associated with a top portion of the handle for retaining one or more articles of clothing
the retainer includes a movable dressing unit that is used to retain the one or more articles of clothing;
the dressing unit is rotated along a reciprocating path from lower position to an angled position to allow one or more articles of clothing to drape behind the dressing unit.

22. A method for dressing, comprising:
providing a free standing portable device for dressing;
associating an outer wear garment with a first retainer of the device;
associating a next garment to be worn underneath the outer wear garment on top of the outer wear garment with the first retainer;
sliding the device with the associated outer and next garment over feet and legs of user.

23. A portable device, comprising:
a base that supports and provides stability for maintaining the portable device in an upright position;
the base defines a workspace for positioning one or more articles of clothing;
a first retainer associated with the base for retaining the one or more articles of clothing within the workspace; and
a handle associated with the base;
wherein the workspace is configured to be maneuvered towards a user for wearing of the one or more articles of clothing without assistance and with minimal physical motion;
the handle is comprised of:
a first piece that has a first end that is coupled with an outer side of a first lateral support of the base near a transverse coupler;
a second piece that has a first end that is coupled with an outer side of a second lateral support of the base near the transverse coupler; and
a cross-coupler that couplers a second ends of a first piece with a second piece;
the cross-coupler includes a second retainer for facilitating dressing for upper garments.

* * * * *